US007389897B2

(12) United States Patent
Pistiolis et al.

(10) Patent No.: US 7,389,897 B2
(45) Date of Patent: Jun. 24, 2008

(54) BABY BAG CONVERTIBLE INTO BABY CARRIER

(75) Inventors: Maria P. Pistiolis, Charlotte, NC (US); Louis J. Foreman, Huntersville, NC (US); Daniel L. Bizzell, Charlotte, NC (US); Ian D. Kovacevich, Charlotte, NC (US)

(73) Assignee: Snuggle Nest, LLC, Charlotte, NC (US)

( * ) Notice: Subject to any disclaimer, the term of this patent is extended or adjusted under 35 U.S.C. 154(b) by 188 days.

(21) Appl. No.: 11/160,001

(22) Filed: Jun. 3, 2005

(65) Prior Publication Data

US 2005/0210594 A1 Sep. 29, 2005

Related U.S. Application Data

(63) Continuation-in-part of application No. 11/051,970, filed on Feb. 3, 2005, now abandoned.

(60) Provisional application No. 60/541,546, filed on Feb. 3, 2004.

(51) Int. Cl.
*A47D 13/02* (2006.01)

(52) U.S. Cl. ..... 224/158; 224/576; 224/577

(58) Field of Classification Search ..... 224/158, 224/576, 577, 159; 190/107, 127; 150/130; *A47D 13/02*
See application file for complete search history.

(56) References Cited

U.S. PATENT DOCUMENTS 3,096,917 A * 7/1963 Gudiksen ..... 294/140
3,297,119 A * 1/1967 Viol ..... 190/8
4,566,130 A 1/1986 Coates
D288,613 S * 3/1987 James et al. ..... D25/56
4,712,258 A * 12/1987 Eves ..... 5/424
4,761,032 A * 8/1988 Sanchez et al. ..... 297/229

(Continued)

FOREIGN PATENT DOCUMENTS

JP 04067815 A * 3/1992

(Continued)

OTHER PUBLICATIONS

Exhibits generated by Applicant comprising Exhibit 1 through Exhibit 23 each representing a photograph of a baby bag convertible into a baby carrier as used in public in Aug. of 2003.

(Continued)

*Primary Examiner*—Nathan J. Newhouse
*Assistant Examiner*—Jack H Morgan, Jr.
(74) *Attorney, Agent, or Firm*—Tillman Wright, PLLC; Chad D. Tillman; James D. Wright

(57) ABSTRACT

A baby bag that is convertible to a baby carrier includes a base that is movable between a folded configuration for storage and transport of the baby bag, and an unfolded configuration for receiving a baby. In an embodiment, a harness is connected to the base for restraining a baby received upon the base such that a back of the baby is maintained in close proximity to the base. In the same or another embodiment, a shoulder strap is attached to the base for suspension of the base, whereby a baby received upon the base may be carried by a person utilizing the shoulder strap.

20 Claims, 26 Drawing Sheets

U.S. PATENT DOCUMENTS

| | | | | |
|---|---|---|---|---|
| 4,999,863 | A * | 3/1991 | Kane | 5/98.1 |
| 5,439,154 | A | 8/1995 | Delligatti | |
| 5,551,108 | A * | 9/1996 | Butler, III | 5/655 |
| 5,826,714 | A | 10/1998 | Martin | |
| 6,168,022 | B1 | 1/2001 | Ward et al. | |
| 6,213,304 | B1 | 4/2001 | Juliussen | |
| 6,298,993 | B1 | 10/2001 | Kalozdi | |
| 6,390,260 | B1 | 5/2002 | Roegner | |
| 6,954,955 | B2 * | 10/2005 | Brewin et al. | 5/655 |
| 2001/0040177 | A1 * | 11/2001 | Hammond | 224/188 |
| 2002/0011503 | A1 * | 1/2002 | Hwang | 224/160 |
| 2002/0050503 | A1 | 5/2002 | Spero | |
| 2005/0051582 | A1 * | 3/2005 | Frost | 224/160 |
| 2006/0096031 | A1 * | 5/2006 | Foster | 5/655 |

FOREIGN PATENT DOCUMENTS

JP 2000296035 A * 10/2000

WO WO02098263 A1 * 12/2002

OTHER PUBLICATIONS

Great Expectation, "Great Expectations Baby Traveller Range of Diaper / Nappy Bags", http://www.greatexpectations.com.au/interiorpages/babytraveller_range.shtml, publication date unknown <accessed May 10, 2005>.

Samsonite, "Samsonite Juvenile Products", http://www.samsonitejuvenile.com/products2.php?collectionID= 1, publication date unknown <accessed May 10, 2005>.

Small Fry Design, "Small Fry Design—Infant and Toddler Toys and Accessories", http://www.smallfrydesign.com/, publication date unknown <accessed May 10, 2005>.

Small Fry Design, "Small Fry Design—Infant and Toddler Toys and Accessories: Travel N Trundle, Mobile Clip, My Playh . . . ", http://www.smallfrydesign.com/accessories.htm, publication date unknown <accessed May 10, 2005>.

Unique Baby Products, "Buggy Bagg—BuggyBagg shopping cart liner", http://www.uniquebabyproducts.com/buggybagg.htm, publication date unknown <accessed May 10, 2005>.

* cited by examiner

BABY BAG CONVERTIBLE INTO BABY CARRIER

CROSS-REFERENCE TO RELATED APPLICATIONS

This application is a continuation-in-part of and claims priority to U.S. patent application Ser. No. 11/051,970, filed Feb. 3, 2005 now abandoned, which is hereby incorporated herein by reference, and which application is a nonprovisional patent application of and claims priority to U.S. Provisional Patent Application No. 60/541,546, filed Feb. 3, 2004, which is hereby incorporated herein by reference.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

A variety of bags intended for use in carrying childcare accessories is commercially available. Available bags are useful for storing and transporting accessories and can be seen in many public environments where care providers such as parents and young children are seen. For example, young mothers carrying children and bags of diaper-changing supplies can often be seen in shopping districts, public parks, and in public transportation facilities. A care provider can face considerable physical prowess and balance challenges in carrying both a child and a typical care accessory bag throughout the course of any typical daily outing. Yet other challenges arise when a diaper needs to be changed. Even if a diaper changing station is available, such as in a public restroom, a parent may have difficulty while trying to comfort and securely hold a child on the hard surface of such a station while fumbling through a bag to find needed supplies. The cleanliness of such a surface and the overall public restroom environment is yet another concern for such a parent and carrying a pad or the like to isolate the child and the supplies only adds further burden in carrying and placing the pad. Indeed, often are seen awkward ad hoc situations in automobiles and lobbies where diaper changing stations are unavailable and a care provider struggles to feed a child or change a diaper without a convenient platform for the execution of the task. Child carriers are available to securely cradle a child but typical carriers are fashioned such that a child essentially must be removed from the carrier for a diaper changing, further complicating the balancing and juggling actions of the care provider.

SUMMARY OF THE INVENTION

The present invention includes many aspects and features. Moreover, while many aspects and features relate to a bag and a carrier, and are described herein in the context of a baby bag that is convertible to a baby carrier, the present invention is not limited to use only in transporting a bag, contents thereof, and a baby. For example, when a bag according to the present invention is converted to a carrier, the carrier is useful as a baby bed and as a diaper changing station without regard to whether a baby is actually carried about or transported, as will become apparent from the following summaries and detailed descriptions of aspects, features, and one or more embodiments of the present invention.

Accordingly, a first aspect of the present invention relates to a baby bag that is convertible to a baby carrier. In one or more examples, a baby bag includes a base and a harness connected to the base. Furthermore, the base is movable between a folded configuration for storage and transport of the baby bag, and an unfolded configuration for receiving a baby, and the harness is configured to restrain a baby received upon the base.

Several variations according to the first aspect relate to the base having a first member hingedly attached to a second member. In one or more examples, moving the base from the folded configuration to the unfolded configuration includes rotating the first and second base members relative to one another. Optionally, overextension of the base is prevented by abutment of a portion of the first base member with the second base member. In another option, an angle of greater than ninety degrees is defined between the first base member and the second base member when the base is in the unfolded configuration.

Another variation relates to a shoulder strap that is removably attached to the base.

Another variation relates to a base member being cushioned for receiving a baby in comfort.

Other variations relate to pockets. In one or more examples, the baby bag includes a plurality of pockets, one of which may be disposed on a member that is connected to the base for hinging movement. Optionally, a pocket is dimensioned to receive a mobile phone. In another option, a pocket dimensioned to receive a baby bottle is disposed on the outside of the baby bag when the base is in the folded configuration. In yet another option, a pocket is dimensioned to receive an umbrella when the base is in the unfolded configuration for shading a baby.

Another variation relates to a canopy for covering a baby when received on the base.

Another variation relates to a collapsible wall attached to and extending around the perimeter of the base for encircling a baby received upon the base when the base is in the unfolded configuration, the wall collapsing toward the base when the base is moved into the folded configuration. In at least one example, the collapsible wall includes sections comprising mesh.

Another variation relates to a cushion for partially surrounding a baby's head when received upon the base. In at least one example, the cushion is removably attached to the base via hook-and-loop fasteners.

Another variation relates to a blanket for covering a baby received upon the base. In at least one example, the blanket is removably attached to the base via hook-and-loop fasteners.

Another variation relates to an anchor strap connected to the base for receipt therethrough of a belt.

A second aspect of the present invention relates to a method of using the convertible baby bag of the first aspect for carrying a baby. This method includes converting the baby bag to the baby carrier in the unfolded configuration, placing a baby upon the base, restraining the baby to the base using the harness, and carrying the base with the baby restrained to the base.

A third aspect of the present invention relates to a baby bag that is convertible to a baby carrier. In one or more examples, a baby bag includes a base and a shoulder strap attached to the base. Furthermore, the base is movable between a folded configuration for storage and transport of the baby bag, and an unfolded configuration for receiving a baby. Moreover, a baby received upon the base may be carried by a person utilizing the shoulder strap.

A fourth aspect of the present invention relates to a method of using the convertible baby bag of the third aspect for carrying a baby. This method includes converting the baby bag to the baby carrier by moving the base into the unfolded configuration, placing the baby upon the base, and suspending the base and the baby by the shoulder strap.

BRIEF DESCRIPTION OF THE DRAWINGS

These and other aspects and features of the invention will be more readily understood upon consideration of the attached drawings and of the following detailed description of particular embodiments of the present invention.

DETAILED DESCRIPTION

Figure 1:
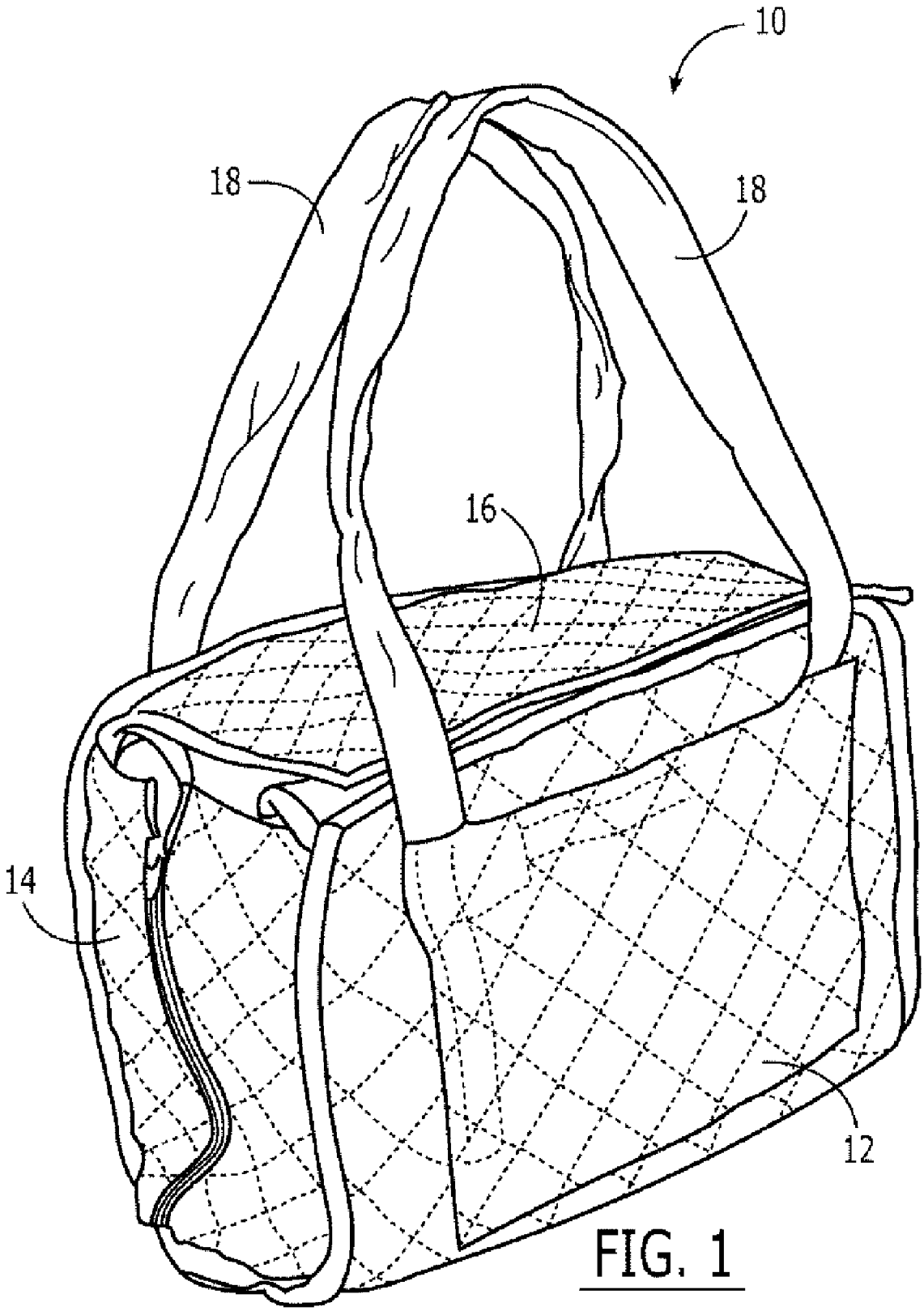
FIG. 1 is a perspective view of a convertible baby bag according to a first embodiment of the present invention.

As a preliminary matter, it will readily be understood by one having ordinary skill in the relevant art ("Ordinary Artisan") that the present invention has broad utility and application. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at lease one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Figure 2:
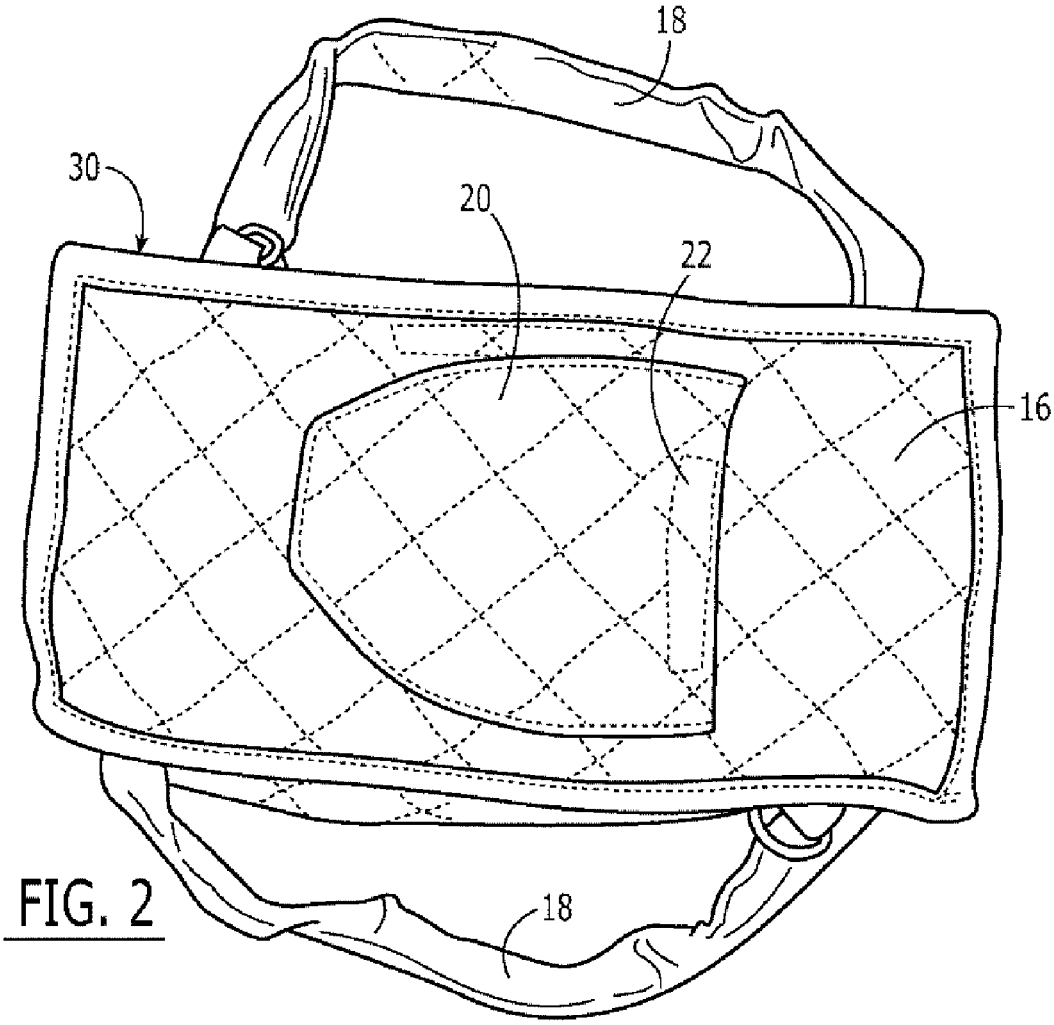
FIG. 2 is a top view of the baby bag of FIG. 1.
Figure 2A:
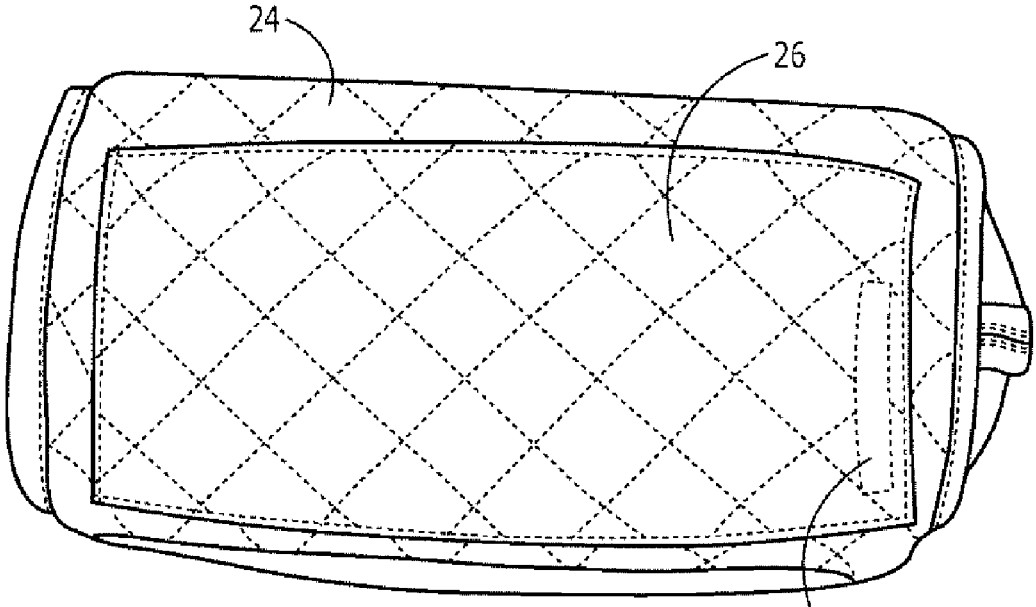
FIG. 2A is a bottom view of the baby bag of FIG. 1.
Figure 3:
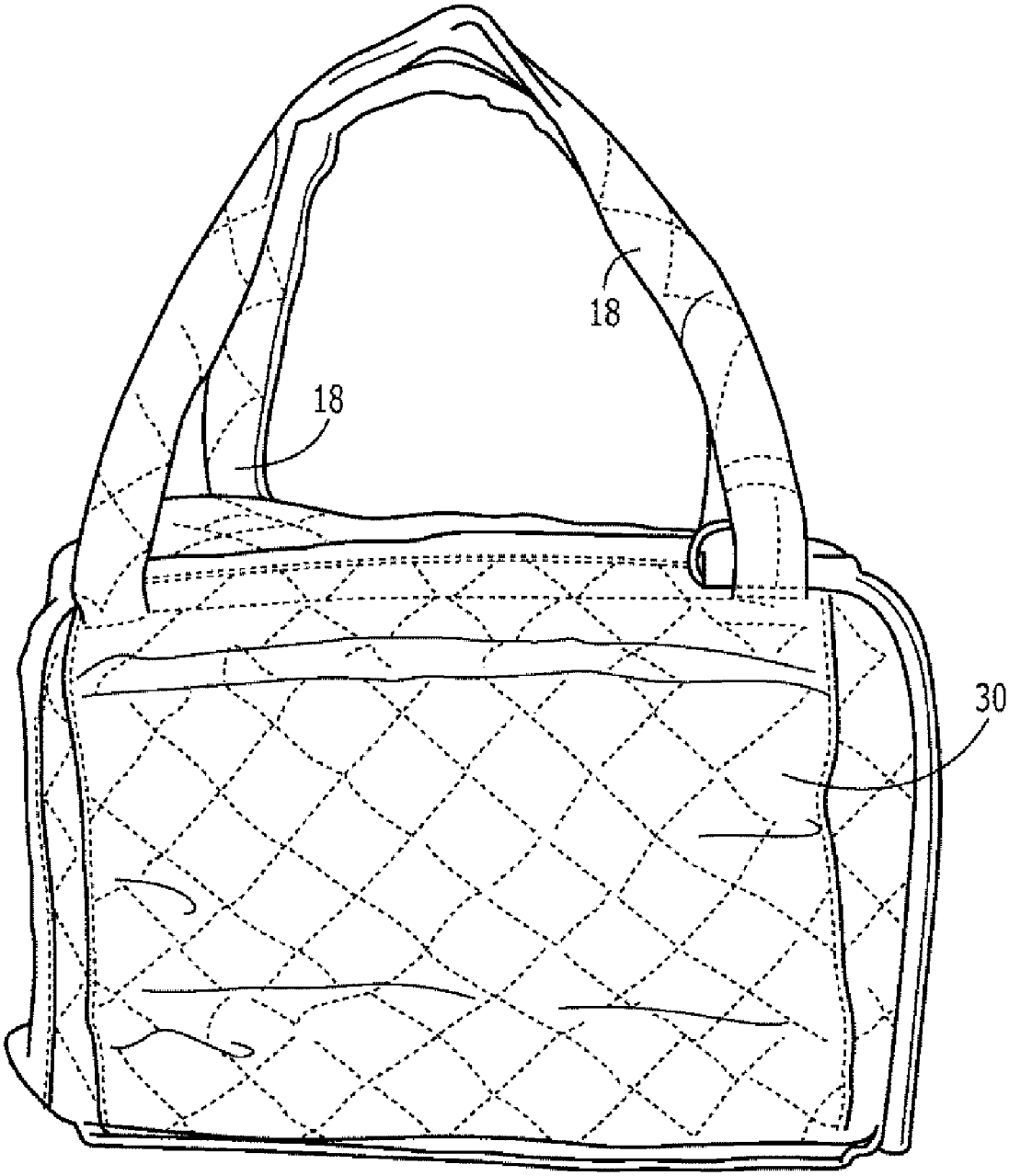
FIG. 3 is a side view of the baby bag of FIG. 1.
Figure 4:
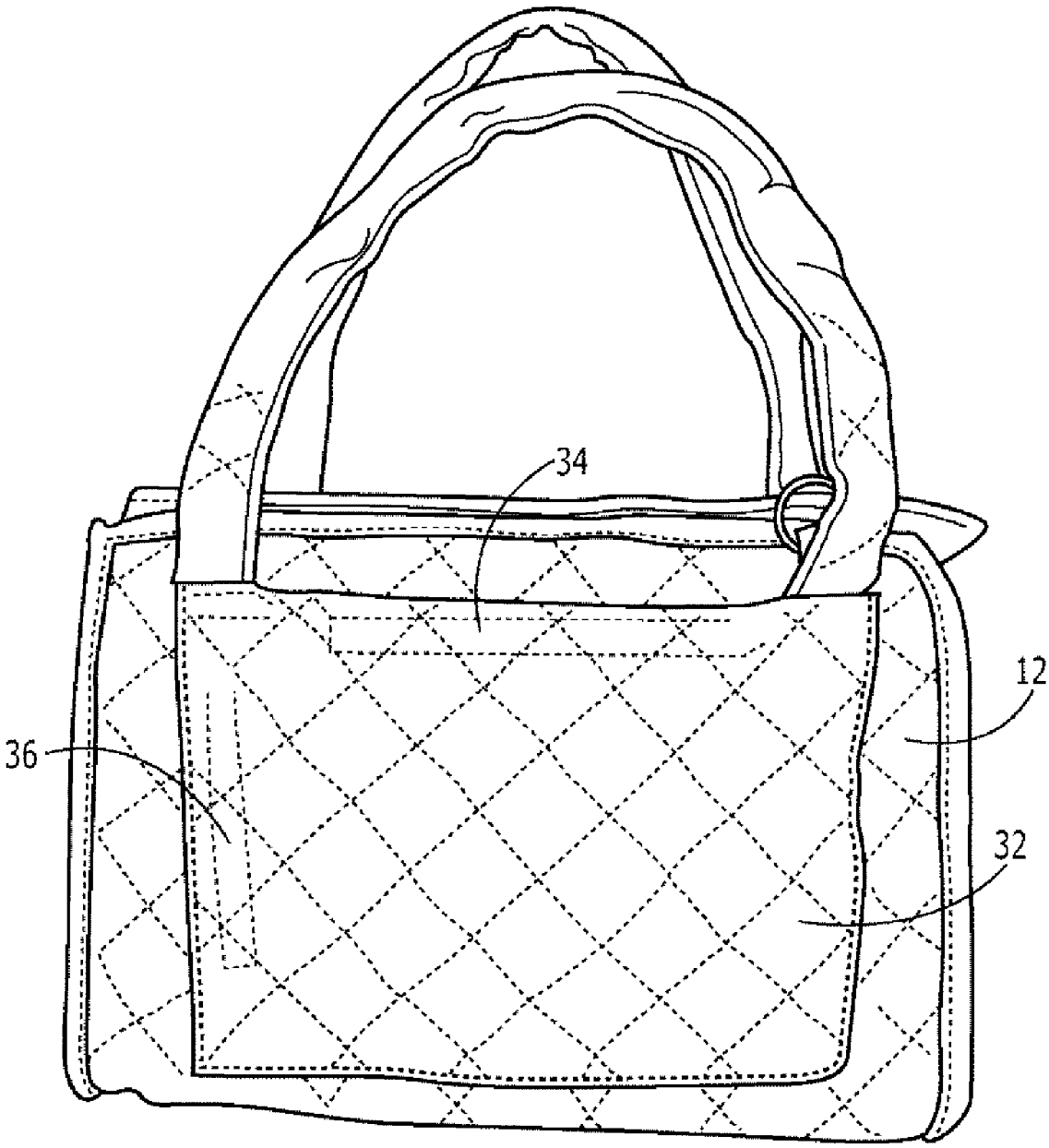
FIG. 4 is an opposite side view of the baby bag of FIG. 1.
Figure 5:
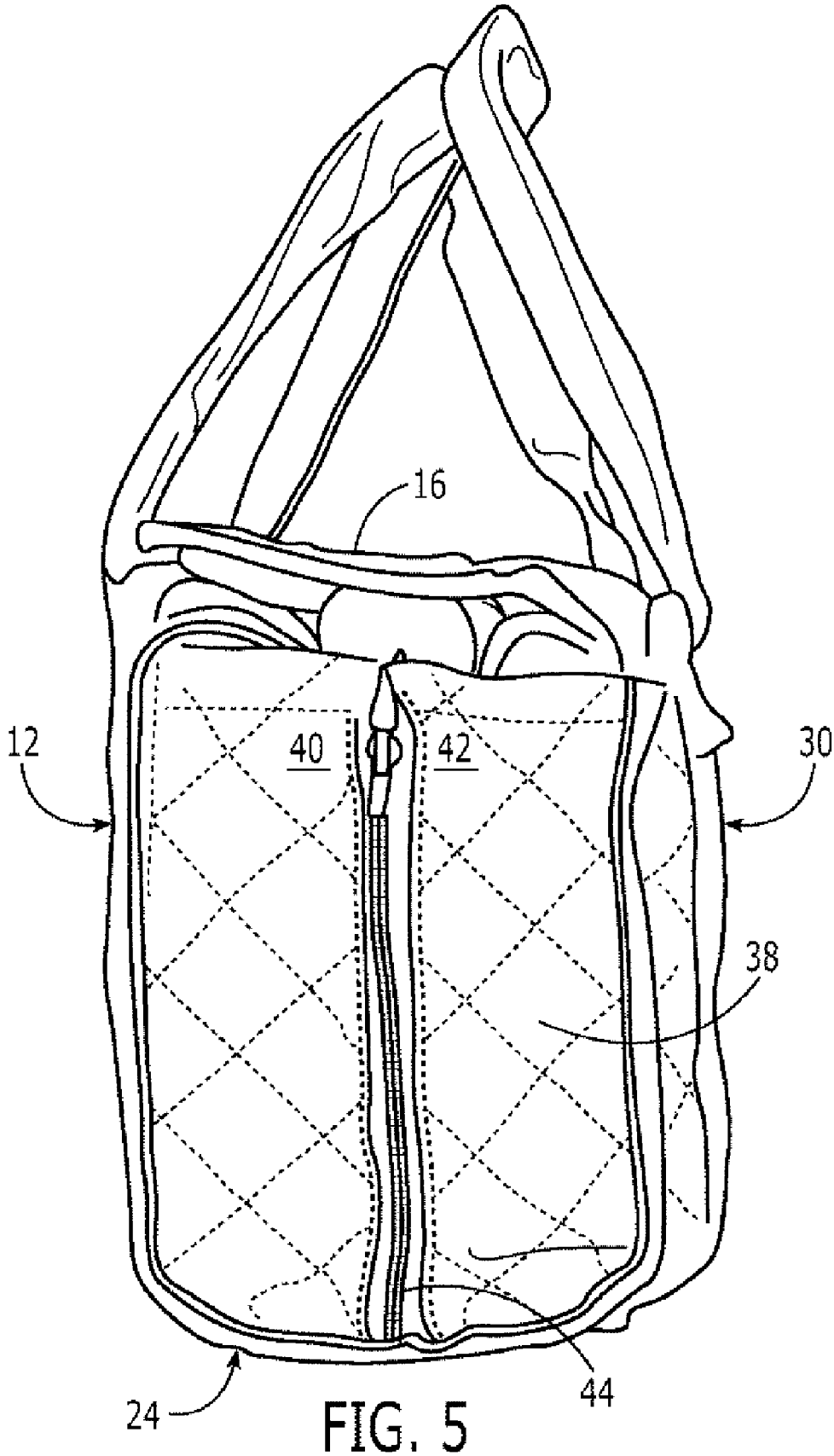
FIG. 5 is an end view of the baby bag of FIG. 1.
Figure 6:
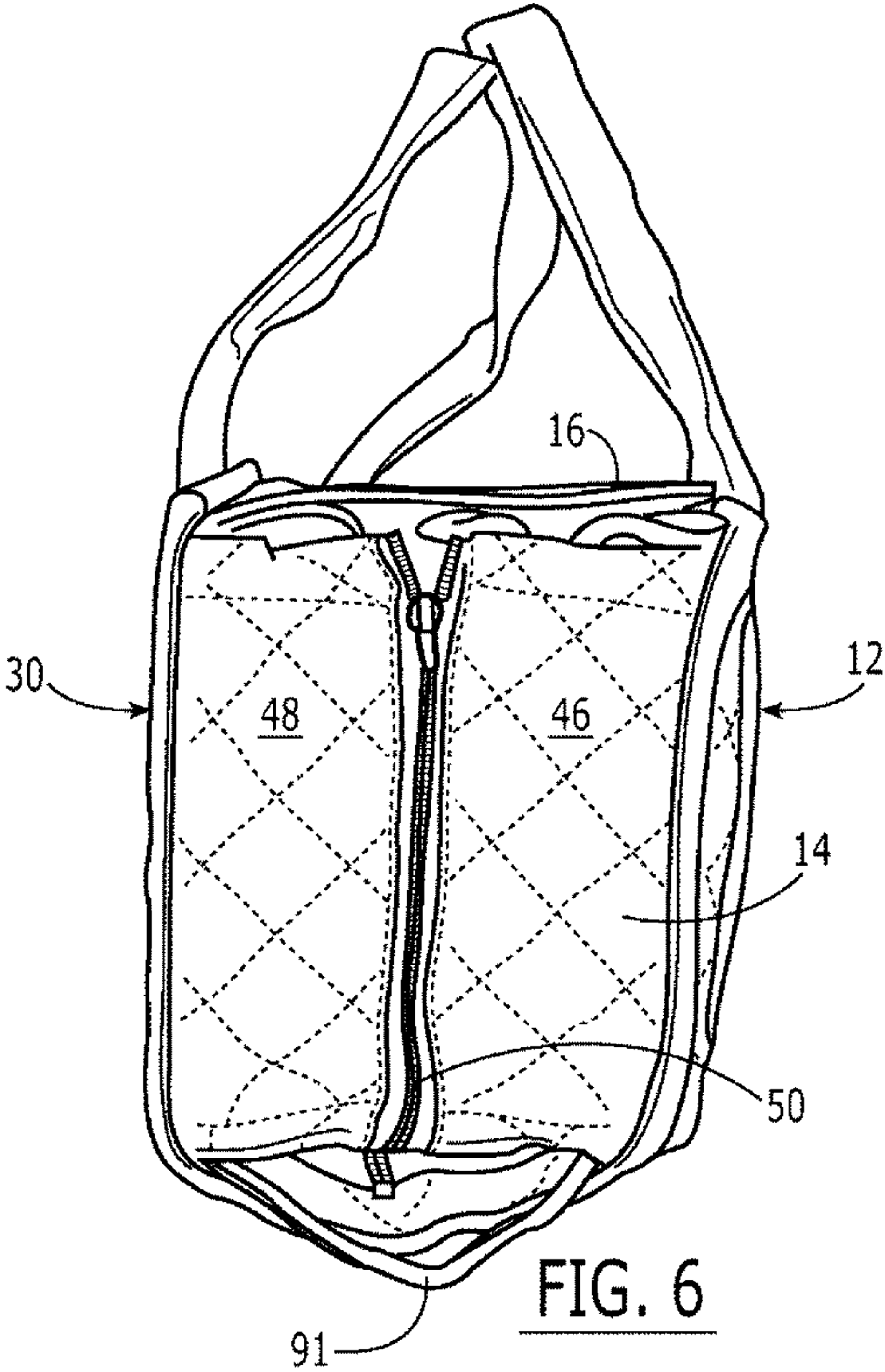
FIG. 6 is an opposite end view of the baby bag of FIG. 1.

Turning now to the drawings, a first embodiment of a baby bag 10 that is convertible into a baby carrier is shown in various views in FIGS. 1-6. A first side 12, a first end 14, a top 16, and purse straps 18 are shown in FIG. 1. The top 16 having purse straps are shown in FIG. 2. The top 16 has a pocket 20 attached thereto and a pocket closure 22 such as an area of hook-and-loop fasteners. In one embodiment, the pocket 20 is specifically dimensioned to receive a mobile phone in snug fit therein. In another embodiment, the pocket 20 is specifically dimensioned to receive a baby bottle in snug fit therein. A bottom 24 is shown in FIG. 2A having a pocket 26 attached thereto and a pocket closure 28 such as an area of hook-and-loop fasteners. A second side 30 is shown in FIG. 3. The top 16 is hingedly attached to the second side 30 defining an opening and closing top of the bag for accessing the major interior thereof. The first side 12 is shown in FIG. 4 having a pocket 32 attached thereto and pocket closures 34,36 such as areas of hook-and-loop fasteners. A second end 38 is shown in FIG. 5 having first and second members 40,42 thereof that are joinable by a connector 44 such as a zipper. The first member 40 of the second end 38 is hingedly attached to the first side 12 and the second member 42 is hingedly attached to the second side 30. The first end 14 is shown in FIG. 6 having first and second members 46,48 thereof that are joinable by a connector 50 such as a zipper. The first member 46 of the second end 14 is hingedly attached to the first side 12 and the second member 48 is hingedly attached to the second side 30.

When the first and second members 46,48 of the first end 14 are joined by the connector 50 as shown in FIG. 6, and the first and second members 40,42 of the second end 38 are joined by the connector 44 as shown in FIG. 5, the bag 10 is configured as a generally rectangular bag having multiple outer pockets having pocket closures. The bag is generally carried by purse straps 18. The major interior of the bag is accessible by hinging the top 16 about its attachment to the second side 30. Articles such as diapers and cleaning cloths optionally stored in the various outer pockets are accessible without unfolding the bag and without reaching deeply into the major interior of the bag.

Figure 7:
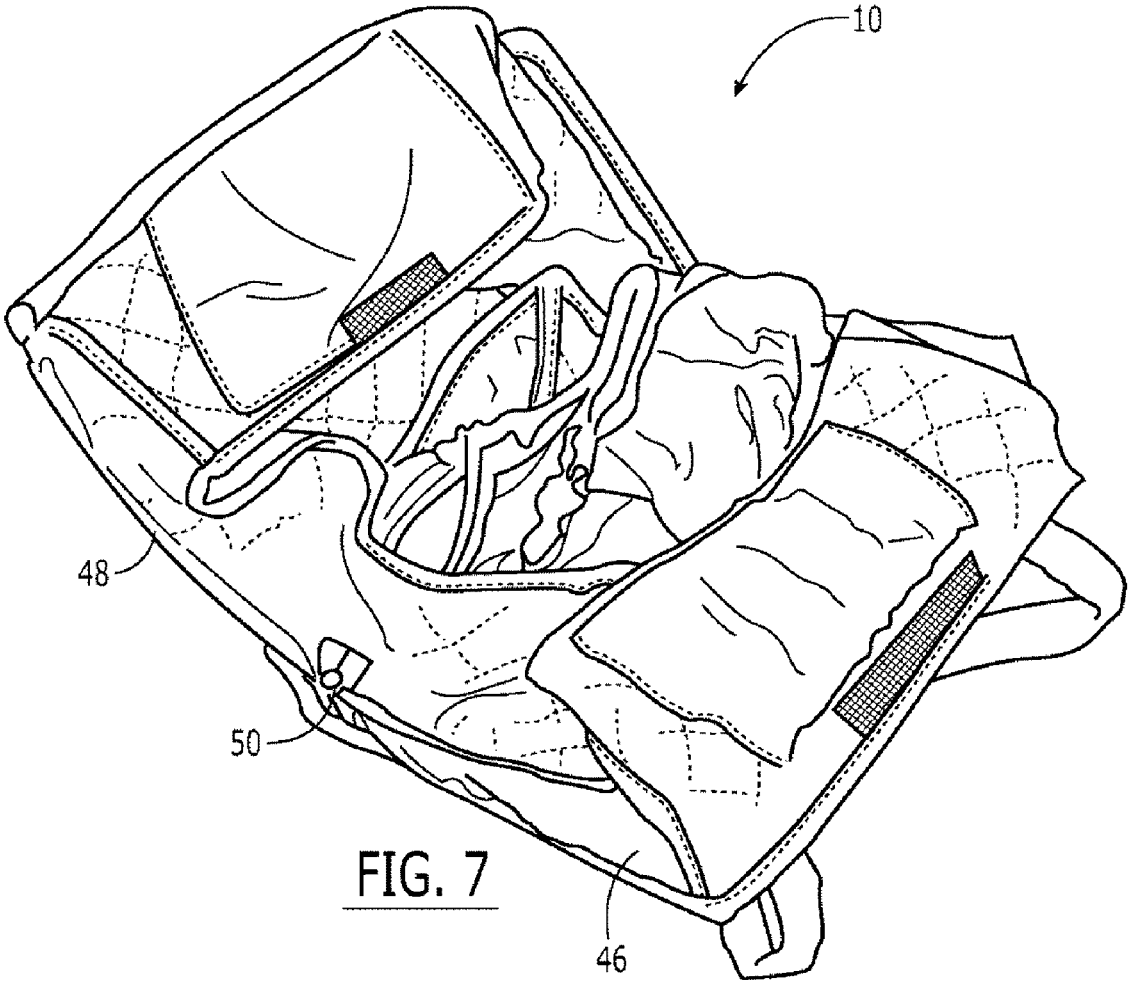
FIG. 7 is a perspective view of the baby bag of FIG. 1 converting to a baby carrier.
Figure 8:
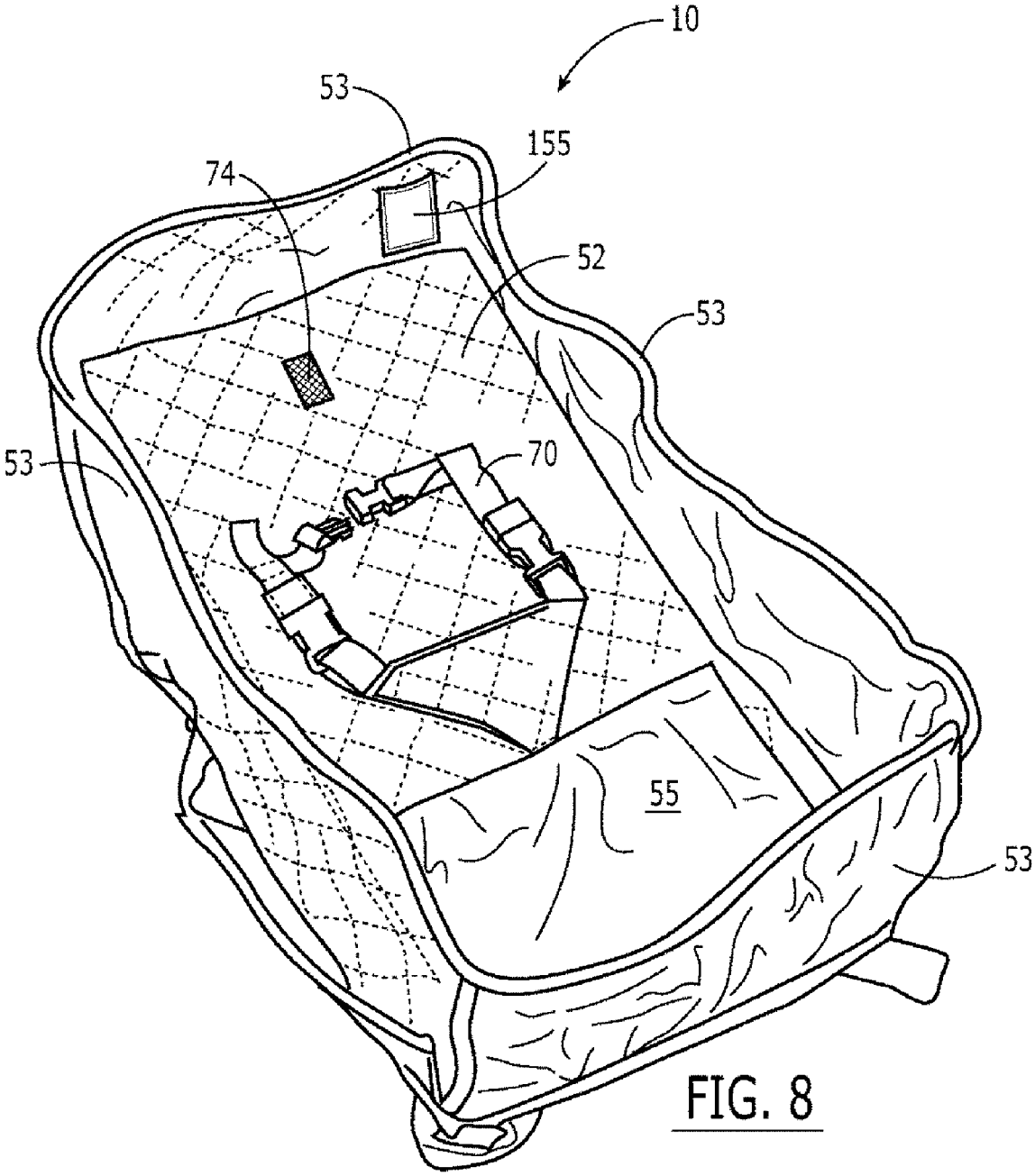
FIG. 8 is a perspective view of the baby bag of FIG. 1 converted to a baby carrier.

The baby bag is convertible to a baby carrier as shown in various views in FIGS. 7-15. In FIG. 7, the connectors 48,50 are released for separation, respectively, of the first and second members 40,42 of the second end 38 and of the first and second members 46,48 of the first end 14, thereby allowing conversion of the baby bag into the baby carrier by unfolding of the baby bag. The configuration shown in FIG. 1 is referred to nominally herein as a folded configuration for storage and transport of the baby bag. The configuration shown in FIG. 8 is referred to nominally herein as an unfolded configuration defining a baby carrier 10 for receiving a baby. FIG. 7 shows the act of converting the baby bag 10 of FIGS. 1-6 into the baby carrier 10 of FIGS. 8-9.

A base of the baby carrier is defined by the sides and bottom of the baby bag. The first side 12 and second side 30 are each hingedly attached to the bottom 24 such that the baby bag 10 (FIG. 6) is convertible to the baby carrier 10 (FIG. 8) by hinging of the first and second sides about the bottom. Thus, in the context of the baby bag 10 (FIG. 6) the items 12,30, and 24 are referred to nominally herein respectively as the first side 12, second side 30, and bottom 24 of the baby bag 10; and, in the context of the baby carrier 10 (FIG. 8) the same items are referred to as members of the base 52.

As shown in FIG. 8, a collapsible wall 53 is attached to the base 52 and extends around the perimeter thereof. The wall 53 is shown as at least partially collapsed in FIG. 7. When the base 52 is in the unfolded configuration (FIG. 8), the collapsible wall 53 is generally upstanding from the base for encircling a baby received upon the base.

Figure 13:
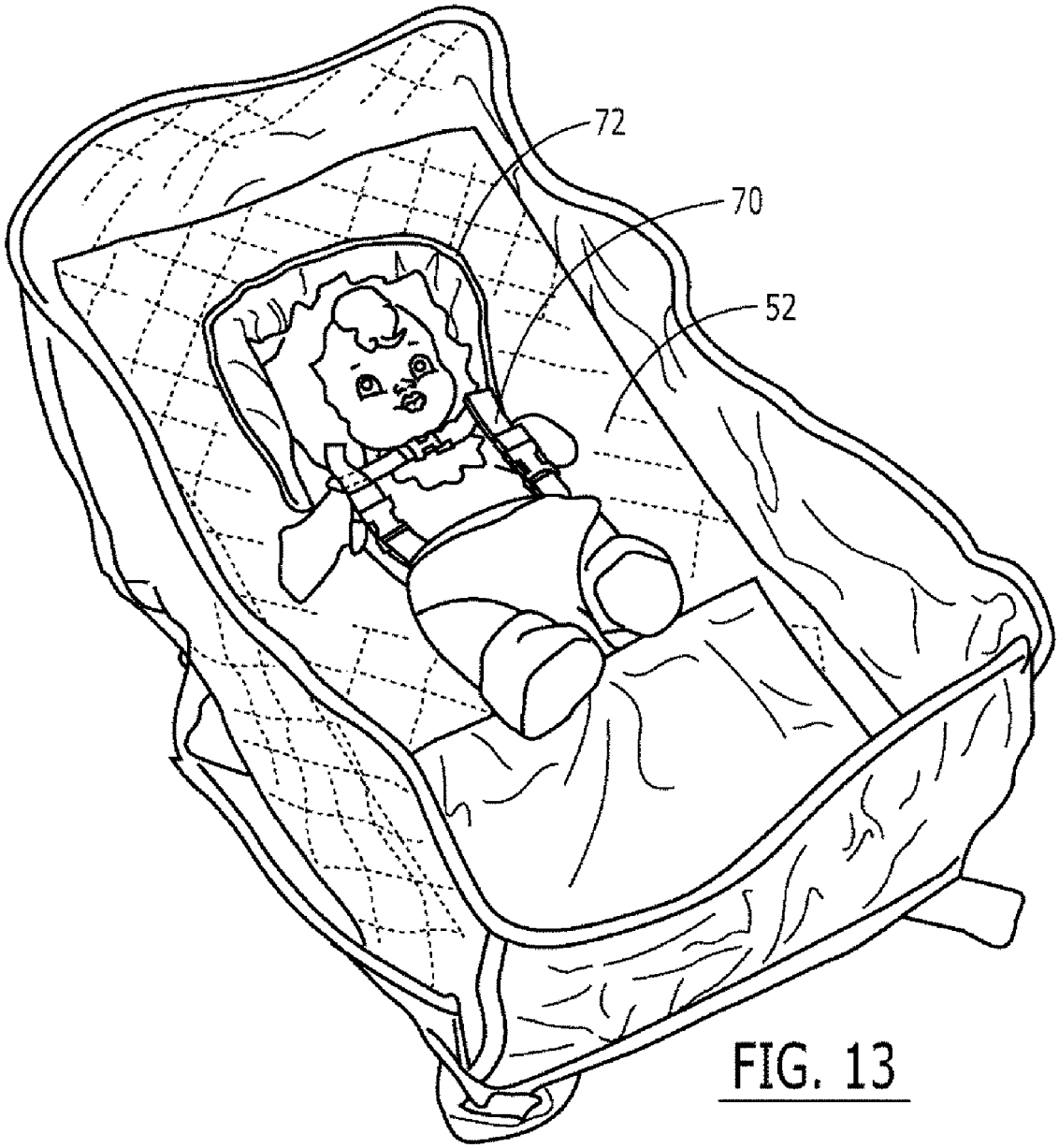
FIG. 13 is a perspective view of the baby carrier of FIG. 8 with a baby received thereon.

A pocket 55 is attached to the base 52 as show in FIG. 8 and has a gathered elastic opening that opens away from a child received on the base (FIG. 13). The pocket 55 is positioned proximal the legs and under the feet of the child. A blanket, diapers, wipes, or other supplies and articles are optionally stored in the pocket 55.

Also as shown in FIG. 8, a pocket 155 optionally is provided on collapsible wall 53. Pocket 155 is specifically dimensioned to receive the base of an umbrella in snug fit therein for shading of a baby received within a harness 70, which harness discussed in further detail below. The umbrella preferably is lightweight whereby the pocket 155 will support the umbrella in a desired position in order to provide the desired shade.

Figure 9:
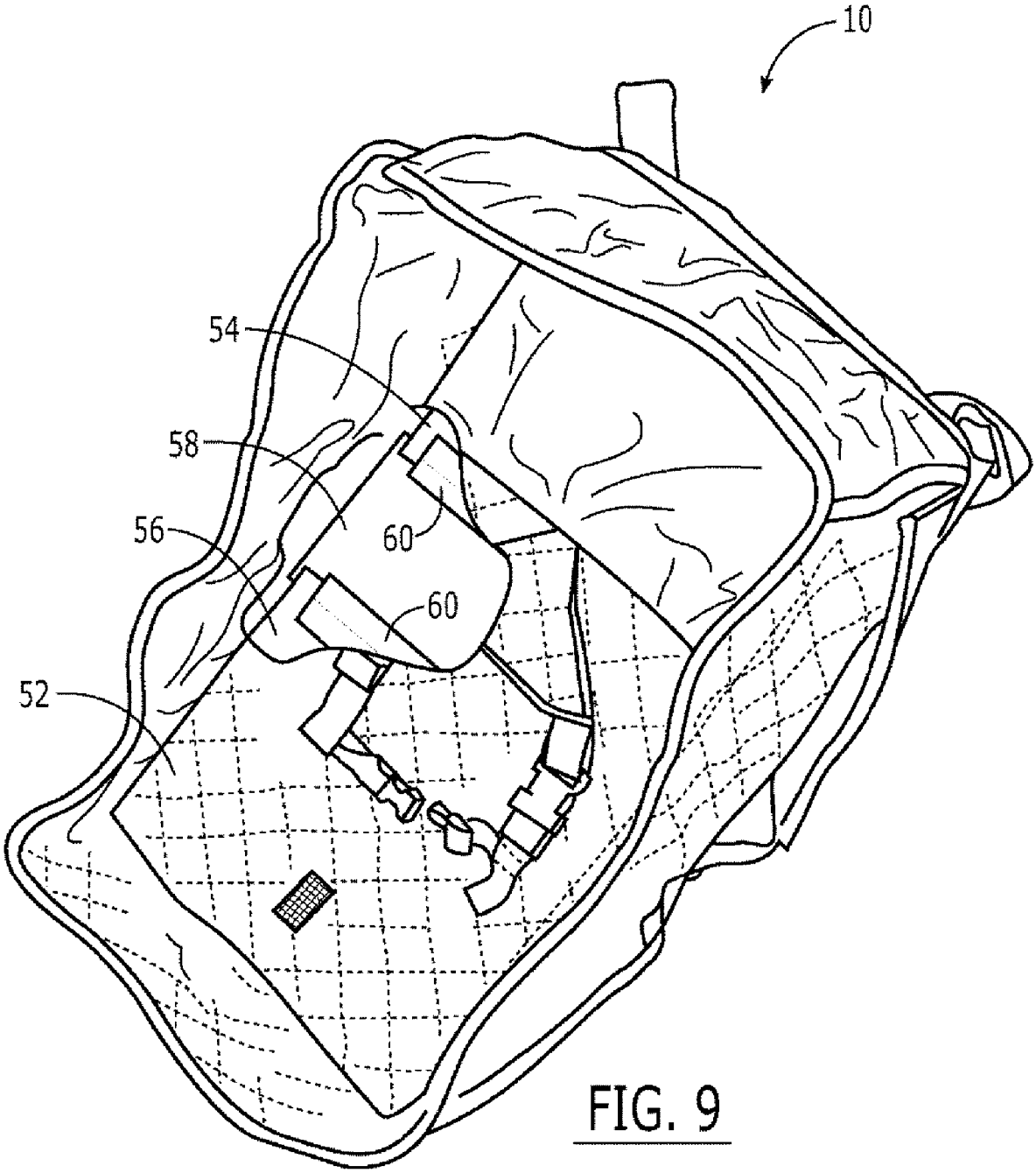
FIG. 9 is a perspective view of the baby carrier of FIG. 8 showing an arrangement of rigid members thereof.
Figure 10:
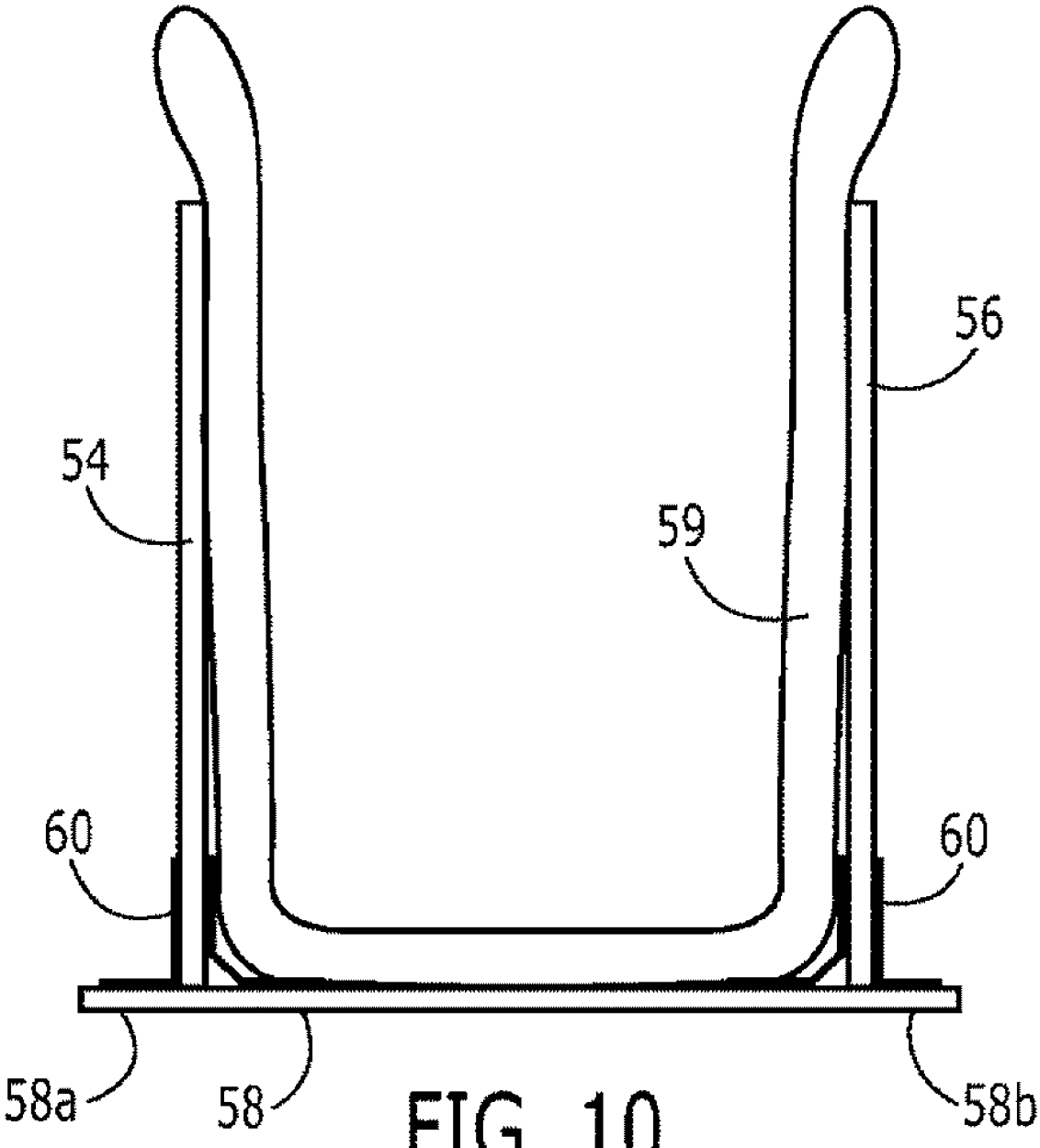
FIG. 10 is an end view of the rigid members of FIG. 9, wherein the rigid members are shown in a folded configuration.
Figure 11:
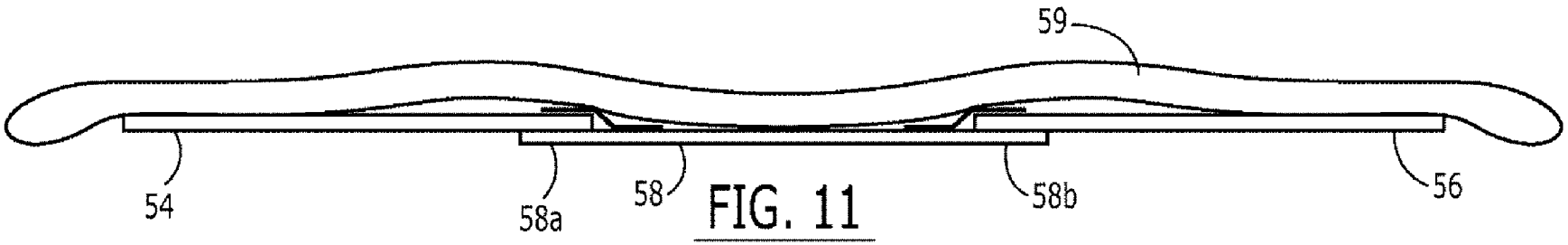
FIG. 11 is an end view of the rigid members of FIG. 9 shown in an unfolded configuration, wherein overextension beyond the unfolded configuration is prevented.

As shown in FIG. 9-11, the base 52 of the baby carrier 10 comprises rigid members that are hingedly attached together. A folded configuration of the base 52 is shown in FIG. 10, wherein rigid side members 54,56 are oriented essentially perpendicularly to a rigid central member 58. The rigid side members 54, 56 are each hingedly attached to the rigid central member 58 by flexible hinging members 60 such that overextension beyond an unfolded configuration of the base as shown in FIG. 111 is prevented by the rigid members 54,56, 58. In particular, respective portions 58*a*,58*b* of the rigid central member 58 extend beyond axes where the rigid side members 54,56 are hingedly attached to the rigid central member 58. Overextension of the rigid side members beyond the unfolded configuration of FIG. 11 is prevented by abutment of the portions 58*a*,58*b* with the rigid side members 54,56 respectively.

In the embodiment shown in FIGS. 9-11, the flexible hinging members 60 comprise flexible portions of fabric that are bonded, adhered, sewn, or otherwise attached to the rigid members of the base while other hinging constructions comprising living hinges and hinges having axles are included in other embodiments. A cushion 59 (FIGS. 10-11) is provided for disposition between the rigid members 54,56,58 and a baby for comfort. Optionally, a washable removable fitted sheet (not shown) or other soft cover receives the cushion and rigid members to retain the cushion in abutment with the rigid members, to protect the cushion from soiling, and to further comfort the baby.

Figure 12:
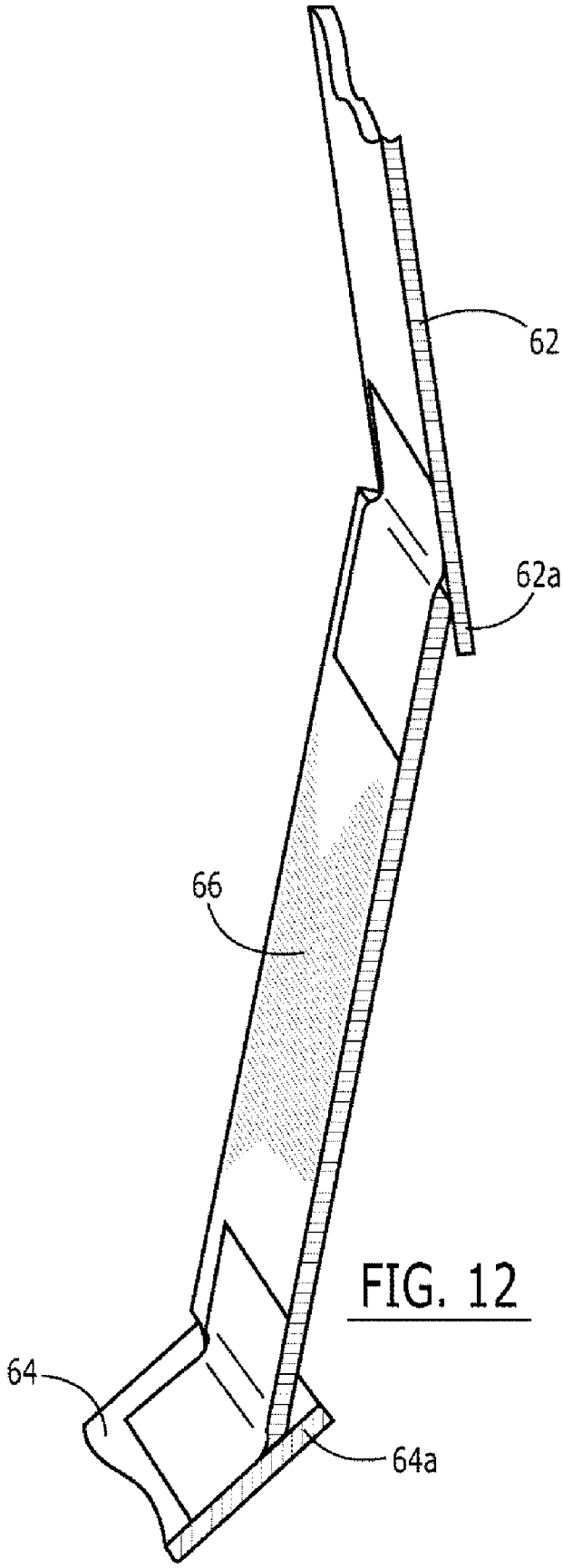
FIG. 12 is a partial perspective view of another arrangement of rigid members for a convertible baby bag, wherein the rigid members are shown in a partially folded configuration.

Another embodiment of an arrangement of rigid members of a base of a baby bag convertible to a baby carrier is partially shown in FIG. 12. In this embodiment, like that of FIGS. 9-11, rigid side members 62,64 are each hingedly attached to a rigid central member 66 by flexible hinging members 68 such that overextension beyond an unfolded configuration is prevented by the rigid members 62,64,66. In this embodiment, however, unlike that of FIGS. 9-11, respective portions 62*a*,64*a* of the rigid side members extend beyond axes where the rigid side members 62,64 are hingedly attached to the rigid central member 66. Overextension of the rigid side members is prevented by abutment of the portions 62*a*,64*a* respectively with the rigid central member 66.

As shown in FIGS. 8 and 13, a harness 70 is connected to the base 52 of the baby carrier for restraining a baby received upon the base when the base is in the unfolded configuration. The harness is configured to restrain a baby such that the back of the baby is maintained in close proximity to the base. In the embodiment shown in FIGS. 8 and 13, the harness 70 comprises straps that extend from the base 52, pass about the shoulders of the child, and connect to a groin area panel that passes between the legs of the child. A breast strap assembly passes across the breast of the child. The harness includes sliding adjusters for providing a comfortable fit about the child and release snaps for conveniently securing and releasing the child.

Furthermore, the baby carrier preferably includes a cushion for partially surrounding and supporting a baby's head when the baby is received on the base. In the embodiment illustrated in FIGS. 8 and 13, the cushion 72 (FIG. 13) is removably attached to the base 52 via hook-and-loop fasteners 74 (FIG. 8). The cushion is provided for comfort and to control the position of the head of the child as may be needed with particular regard to young infants.

Figure 14:
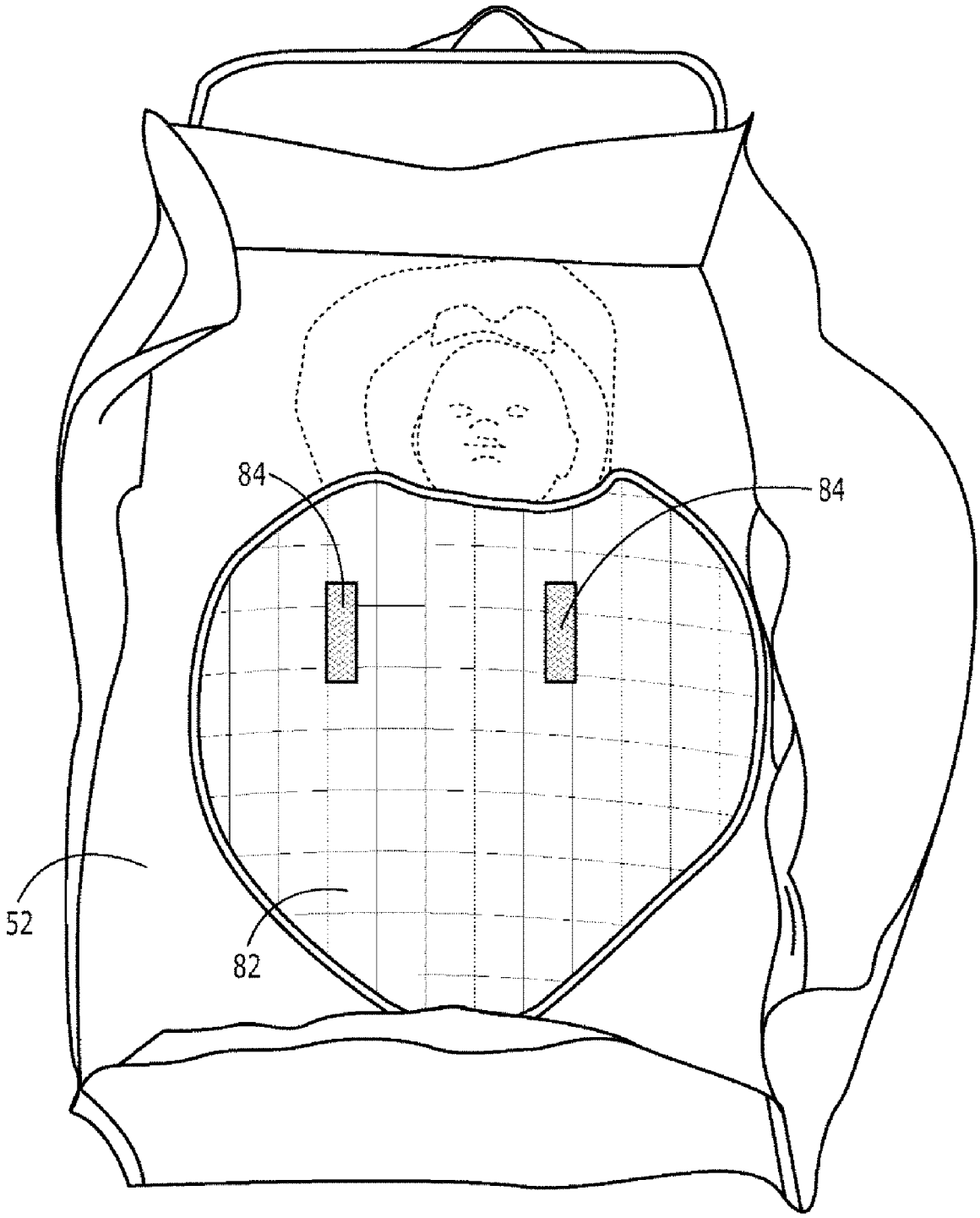
FIG. 14 is another perspective view of the baby carrier of FIG. 13.
Figure 15:
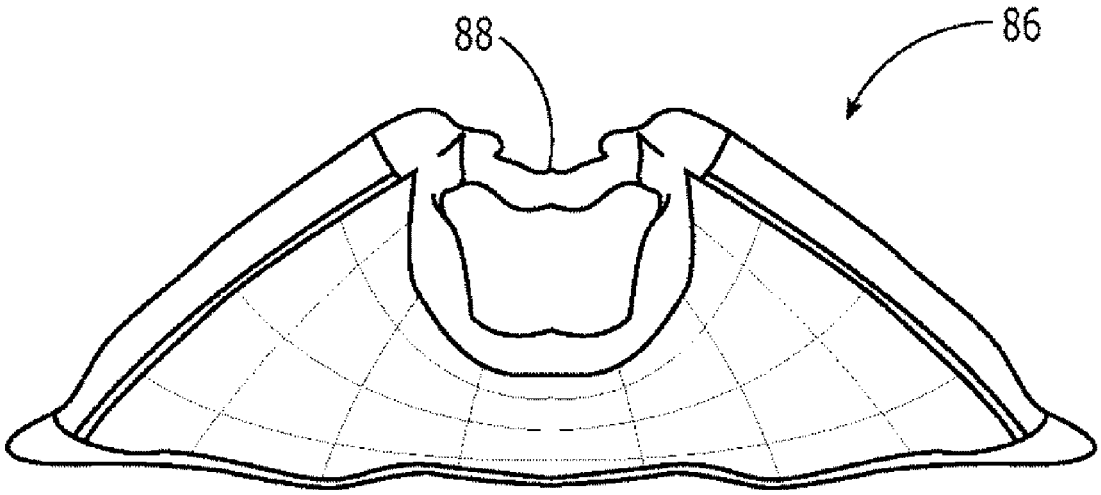
FIG. 15 is a side elevational view of a bottle support according to an embodiment of the invention.
Figure 16:
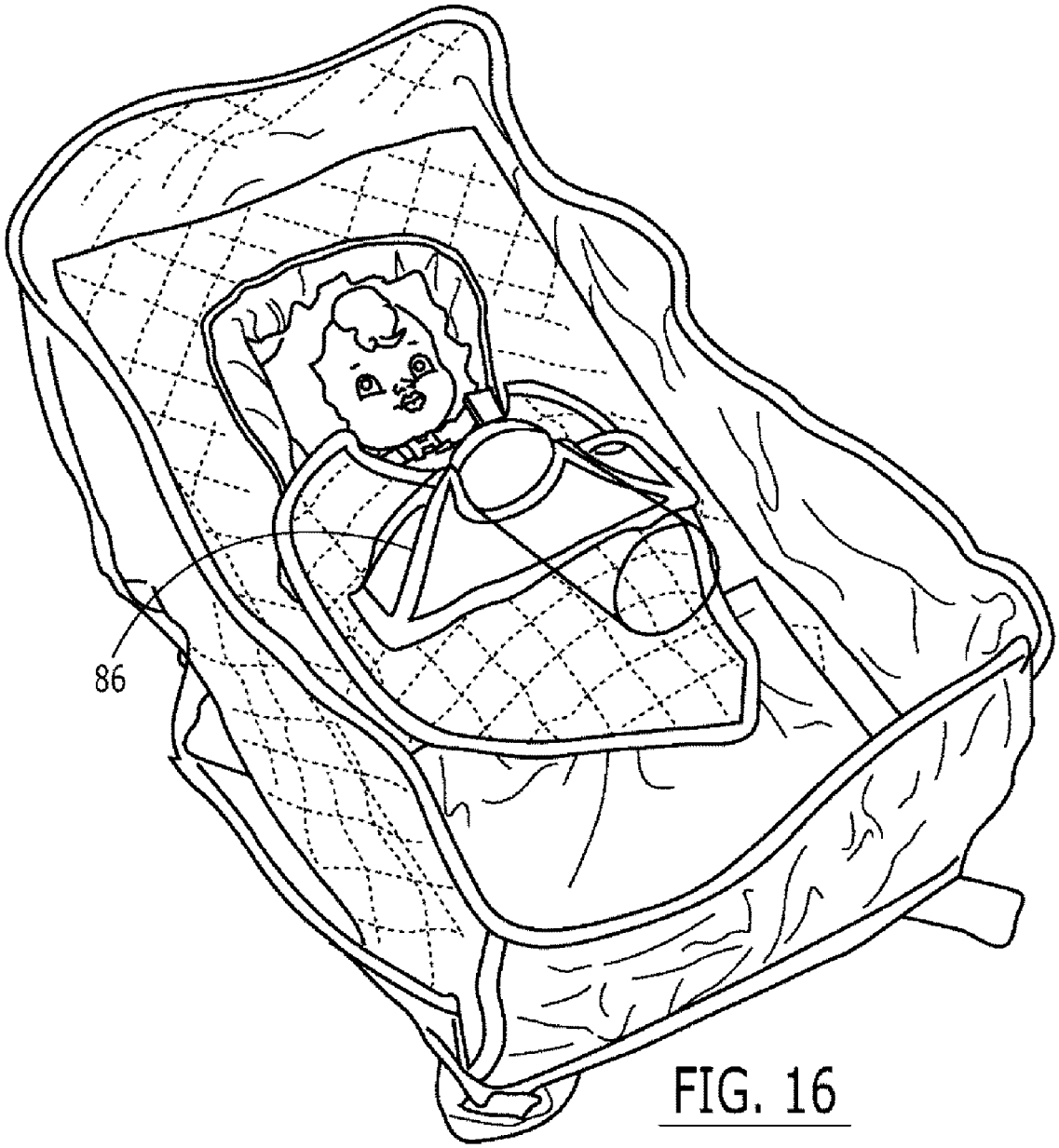
FIG. 16 is a perspective view of the baby carrier and baby of FIG. 13, wherein a baby bottle is supported by the bottle support of FIG. 15.

A blanket 82 is shown covering much of the child in FIG. 14. The blanket 82 is optionally removably attached to the base 52 via hook-and-loop fasteners (not shown). Securing pads 84 attached to the blanket are for securing a bottle support 86 (FIG. 15) to the blanket as shown in FIG. 16. In the illustrated embodiment, the securing pads 84 (FIG. 14) comprise hook-and-loop fasteners for engaging corresponding fasteners on the bottom of the bottle support. The bottle support 86 is shown in FIG. 16 with a bottle therein such that the bottle is supported by the support and is retained by a strap 88 (FIG. 15) of the bottle support 86 such that the child may comfortably feed from the bottle.

Figure 17:
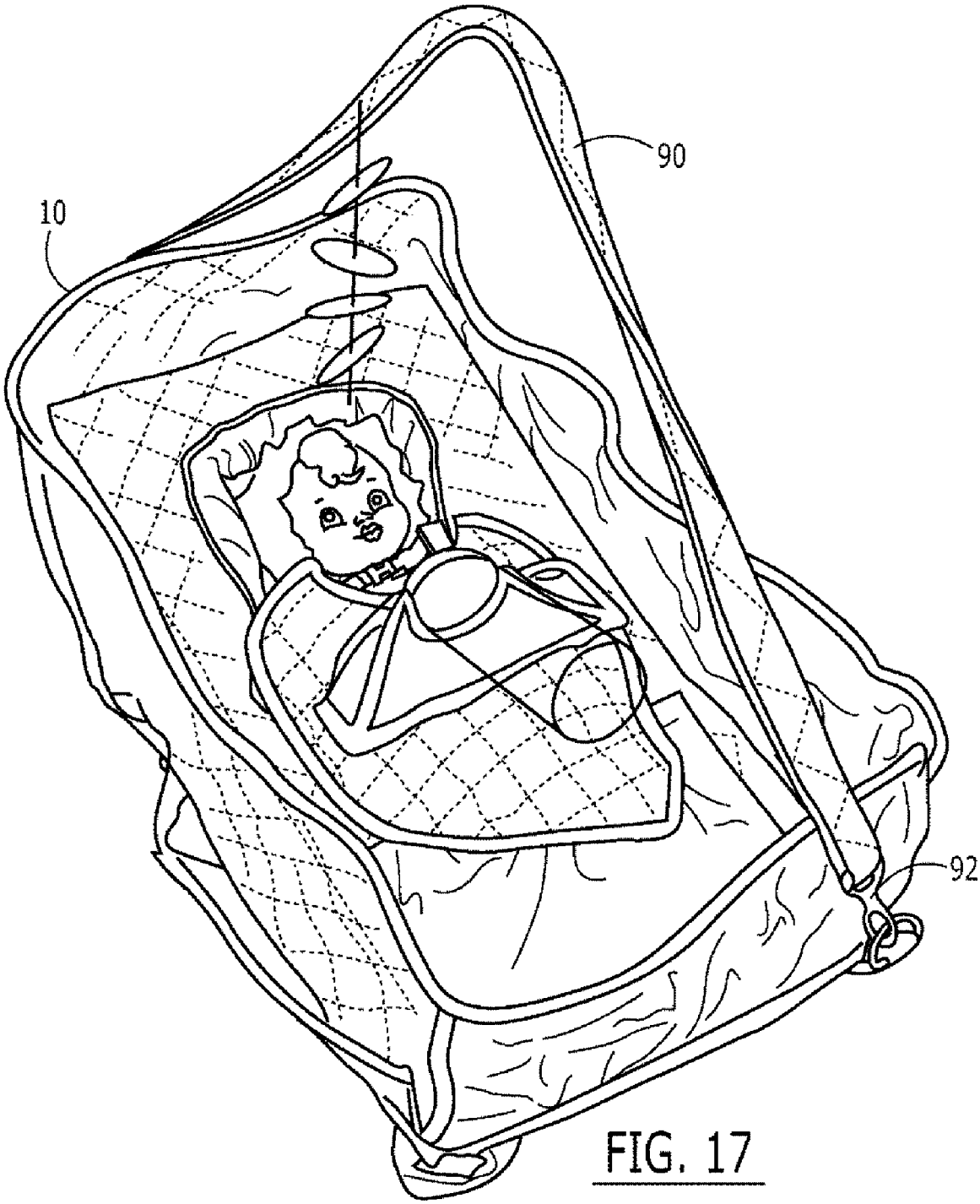
FIG. 17 is a perspective view of the baby carrier and baby of FIG. 13, wherein the carrier is suspended from a shoulder strap.
Figure 18:
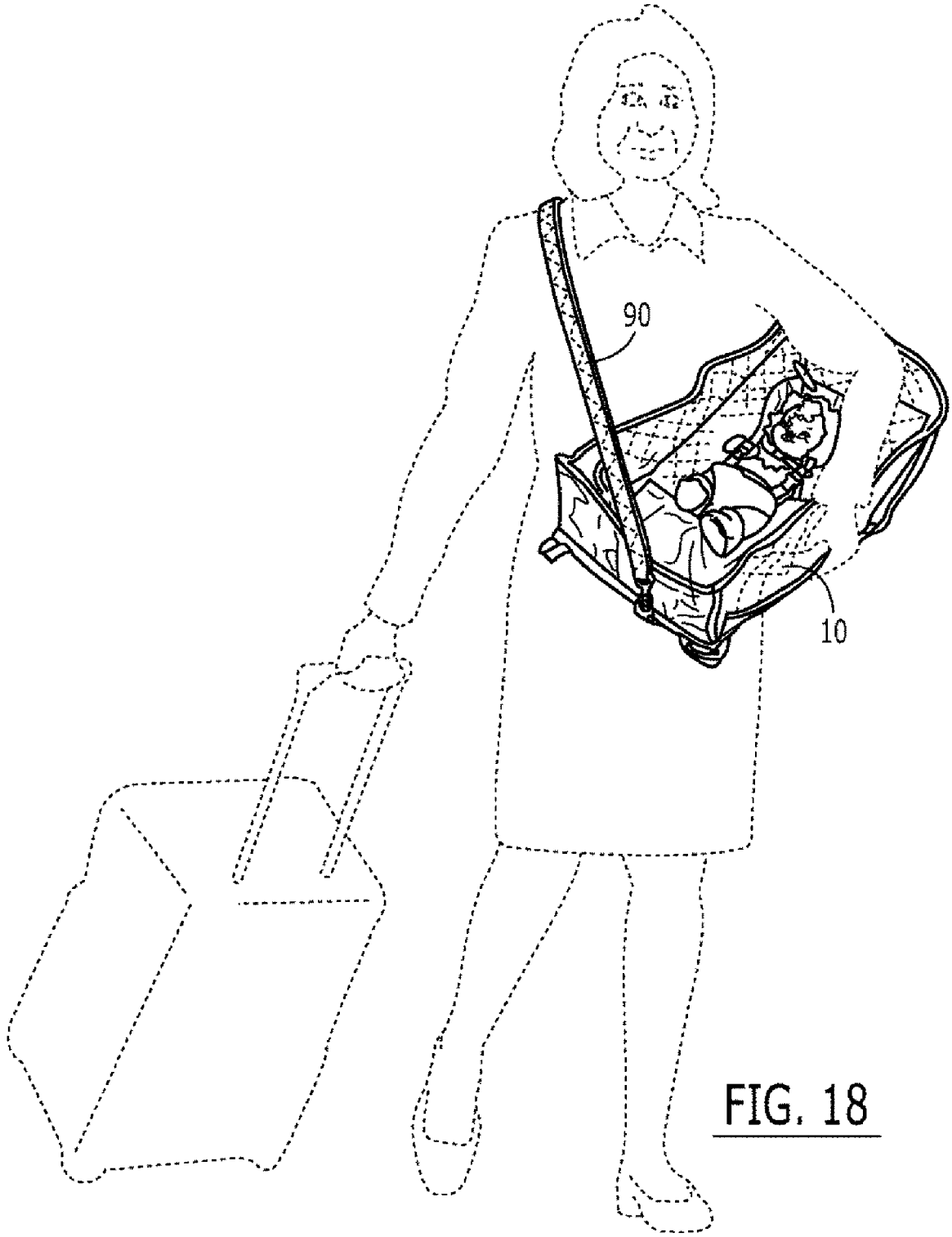
FIG. 18 is a perspective view of the baby carrier and baby of FIG. 13 carried by a person utilizing the shoulder strap as in the arrangement of FIG. 17.

A shoulder strap 90 is provided for suspension of the baby carrier 10 therefrom when the baby carrier is in the unfolded configuration as shown in FIGS. 17-18. The shoulder strap 90 is capable of being removably attached to the baby carrier, for example, by way of releasable clips 9 (FIG. 17) each located at an opposing end of the baby carrier 10. A baby received by the baby carrier may be carried by a person utilizing the shoulder strap as shown in FIG. 18. Toys hanging on a cord may be attached to the shoulder strap, as shown in FIG. 17, which will swing and move for the amusement of the child as the baby carrier is carried.

Figure 19:
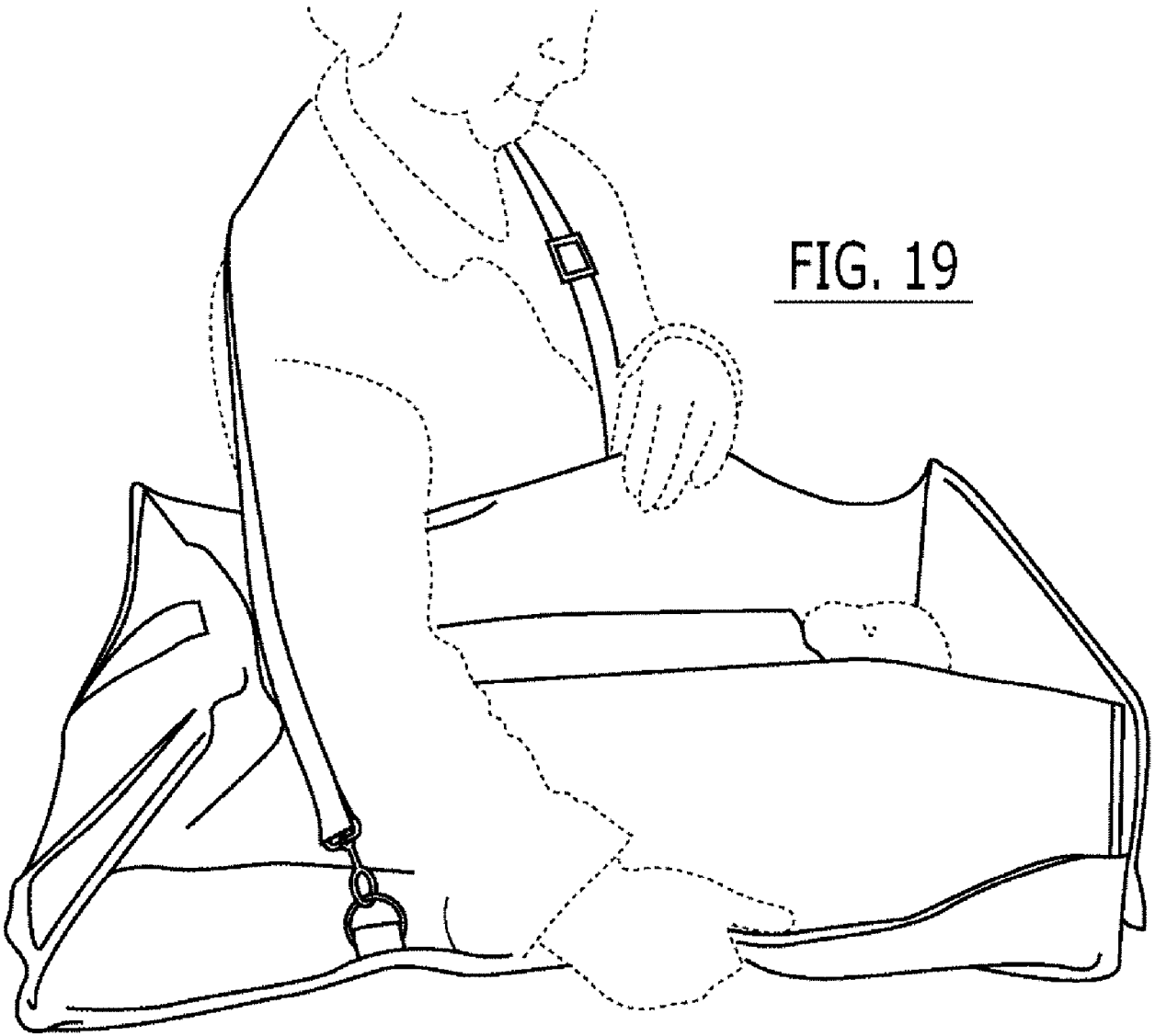
FIG. 19 is a perspective view of the baby carrier of FIG. 13 carried by a person utilizing the shoulder strap in an alternative arrangement.

Additionally or alternatively, a shoulder strap is removably attached to the baby carrier at opposing sides of the carrier such that the baby carrier may be carried by a person utilizing the shoulder strap, as shown in FIG. 19. In the arrangement of FIG. 19, a shoulder strap is attached to the base of the carrier proximal the rigid central member 58 (FIGS. 9,11) such that, upon lifting the carrier by the strap, biasing of the carrier toward the folded configuration is minimized or avoided. For additional security, a belt worn about the waist of the person utilizing the shoulder strap may be passed through an anchor strap 91 (FIG. 6) attached to the base of the carrier.

Figure 20:
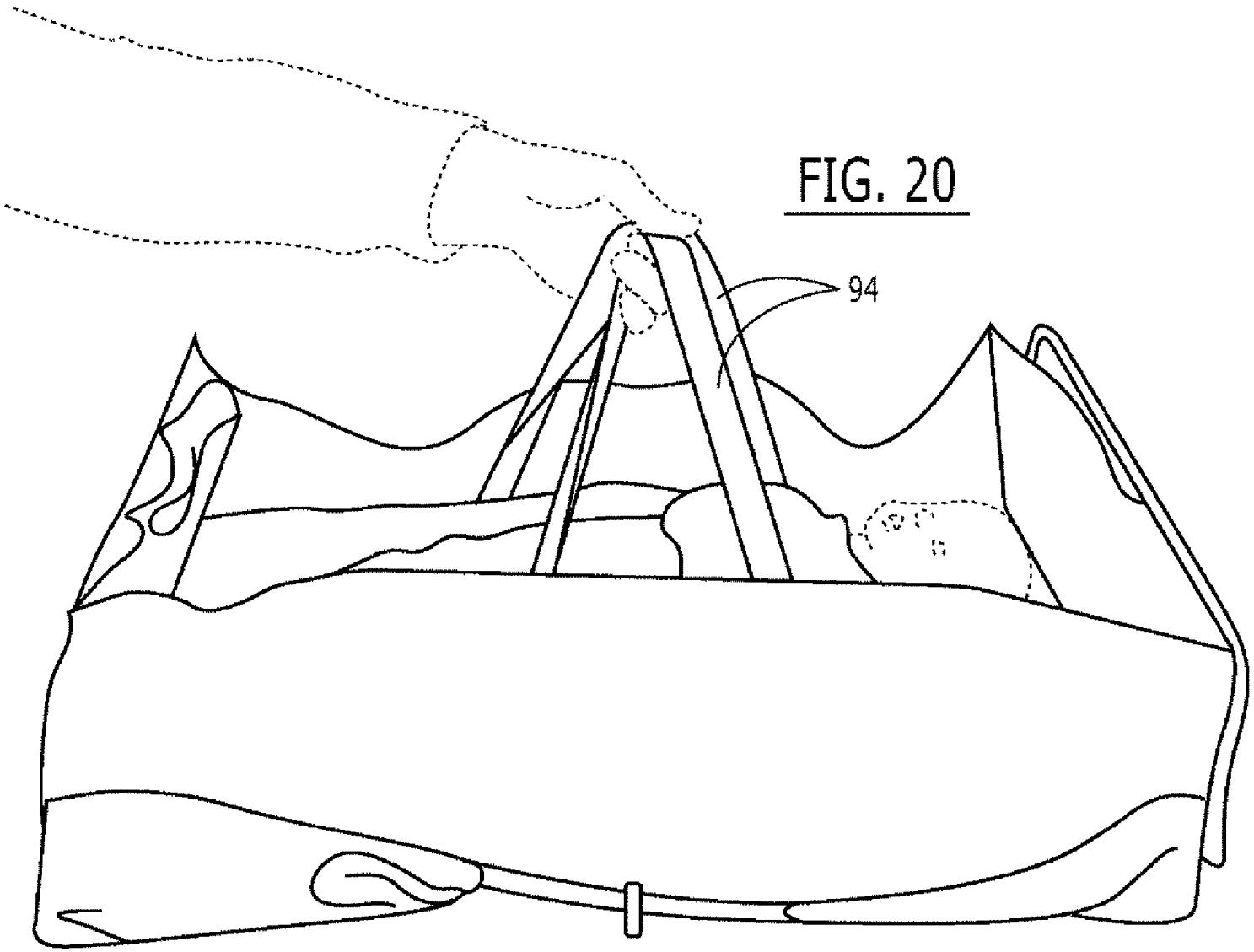
FIG. 20 is a perspective view of the baby carrier of FIG. 13 supported by other straps.

Additionally or alternatively, the baby carrier is capable of being supported by straps 94 as shown in FIG. 20. The straps 94 are attached to the base of the carrier proximal the rigid central member 58 (FIGS. 9,11) such that, upon lifting the carrier by the straps as shown in FIG. 20, biasing of the carrier toward the folded configuration is minimized or avoided.

Figure 21:
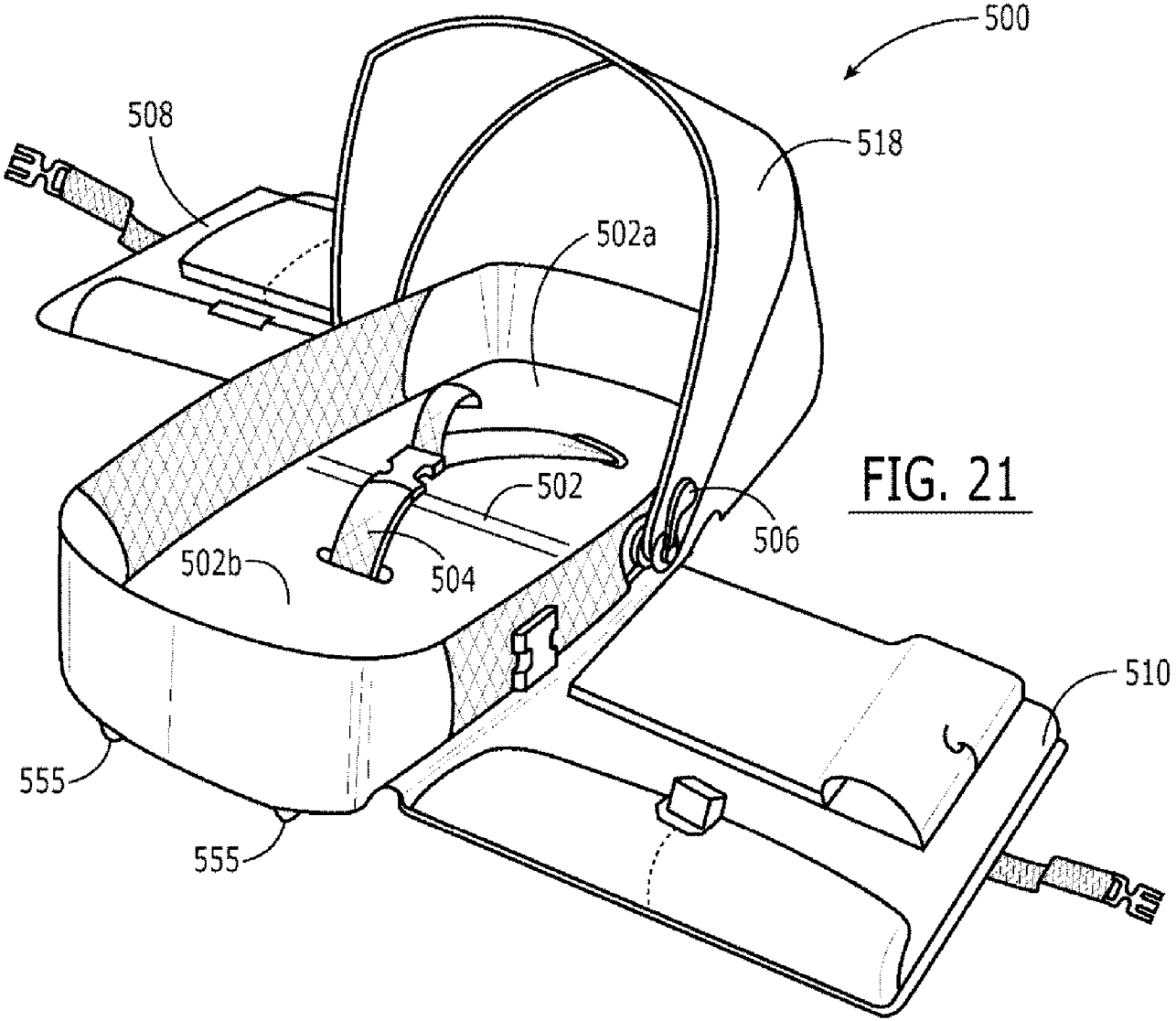
FIG. 21 is a perspective view of a second embodiment of the present invention, wherein a convertible baby bag is shown in an unfolded configuration to define a baby carrier.
Figure 22:
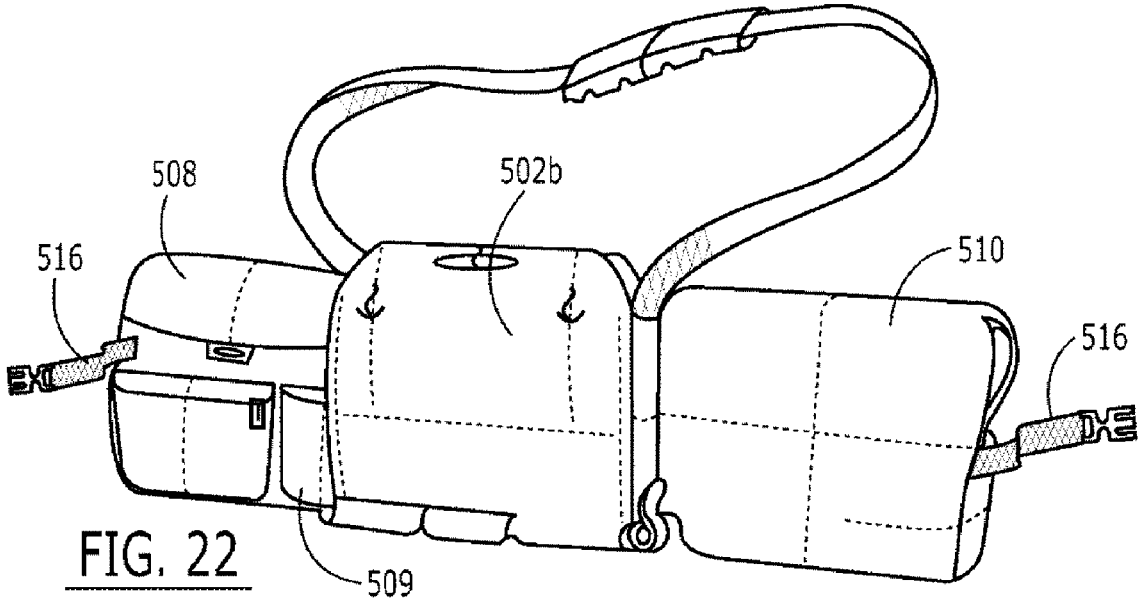
FIG. 22 is a perspective view of the convertible baby bag of FIG. 21, wherein the base thereof is shown in a folded configuration.
Figure 23:
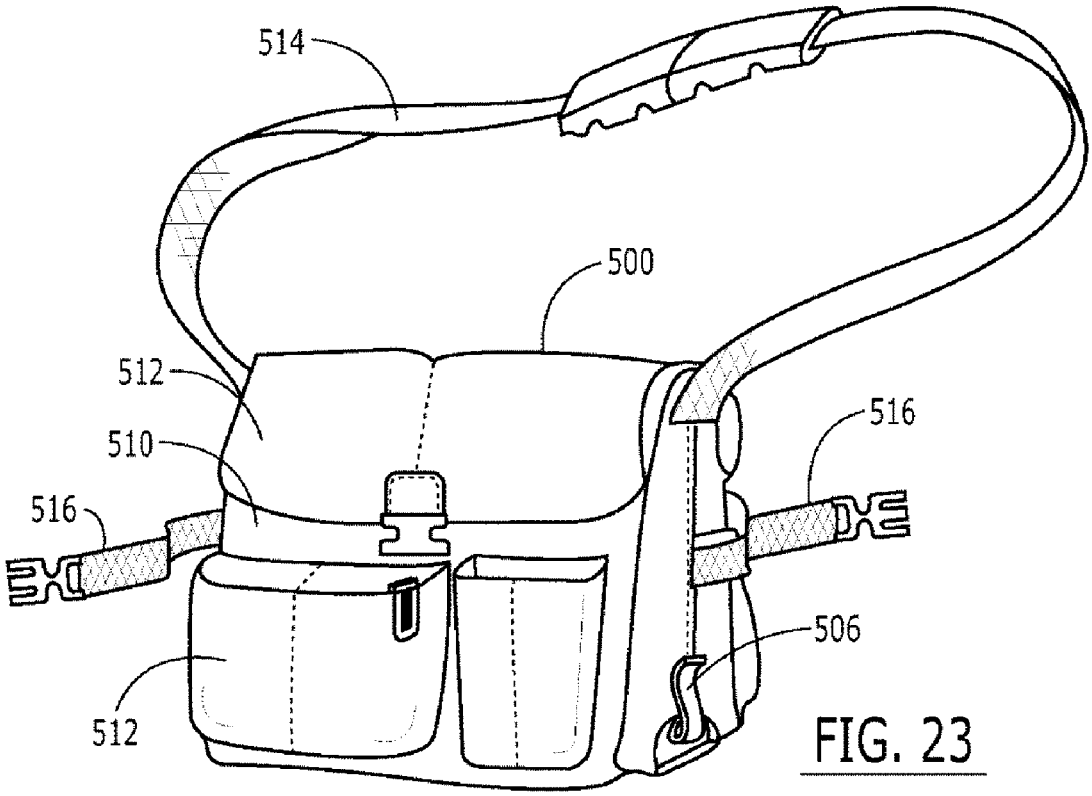
FIG. 23 is a perspective view of the convertible baby bag of FIG. 21 in a fully folded configuration.
Figure 24:
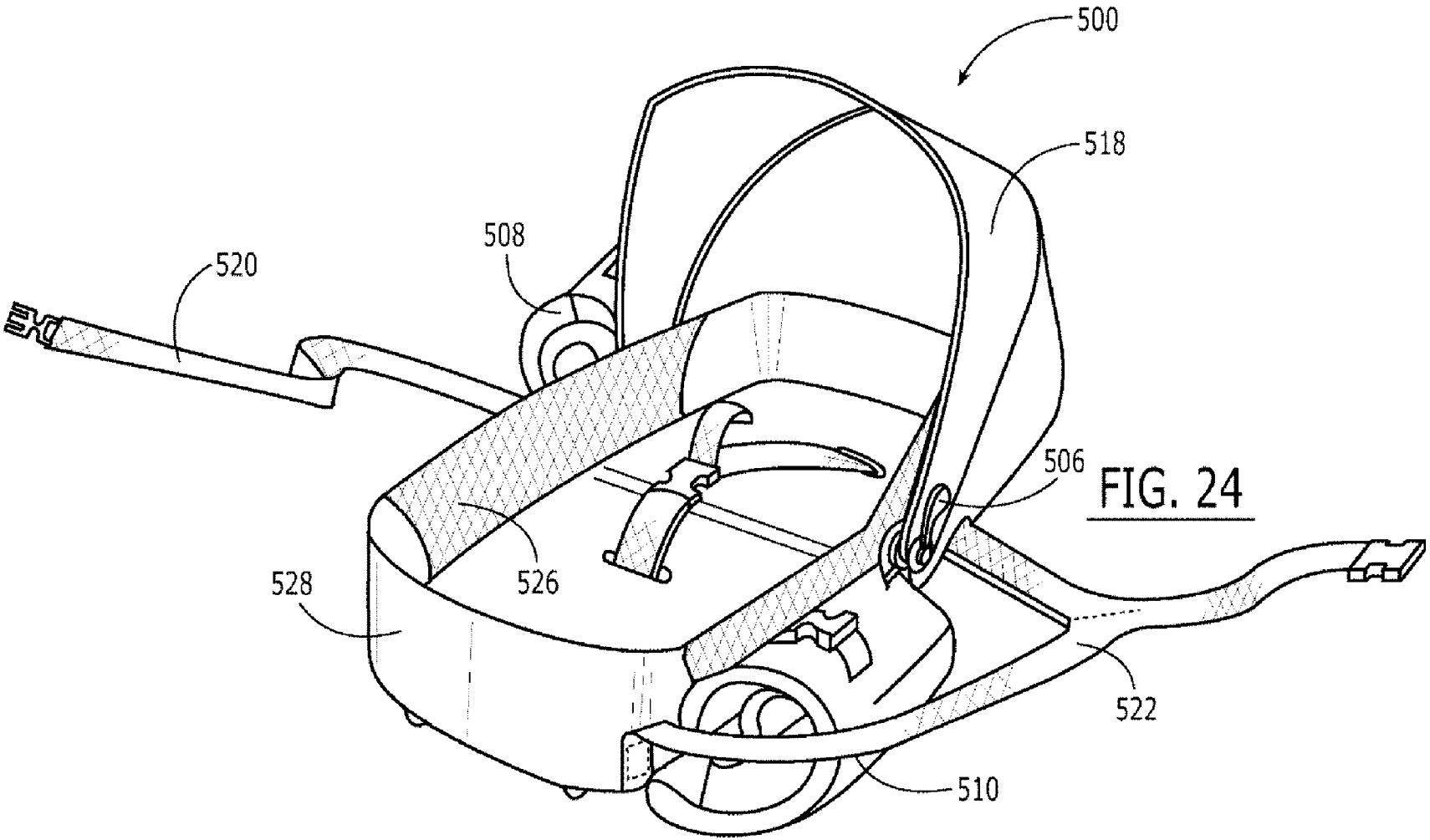
FIG. 24 is another perspective view of the convertible baby bag of FIG. 21 in an unfolded configuration defining a baby carrier.
Figure 25:
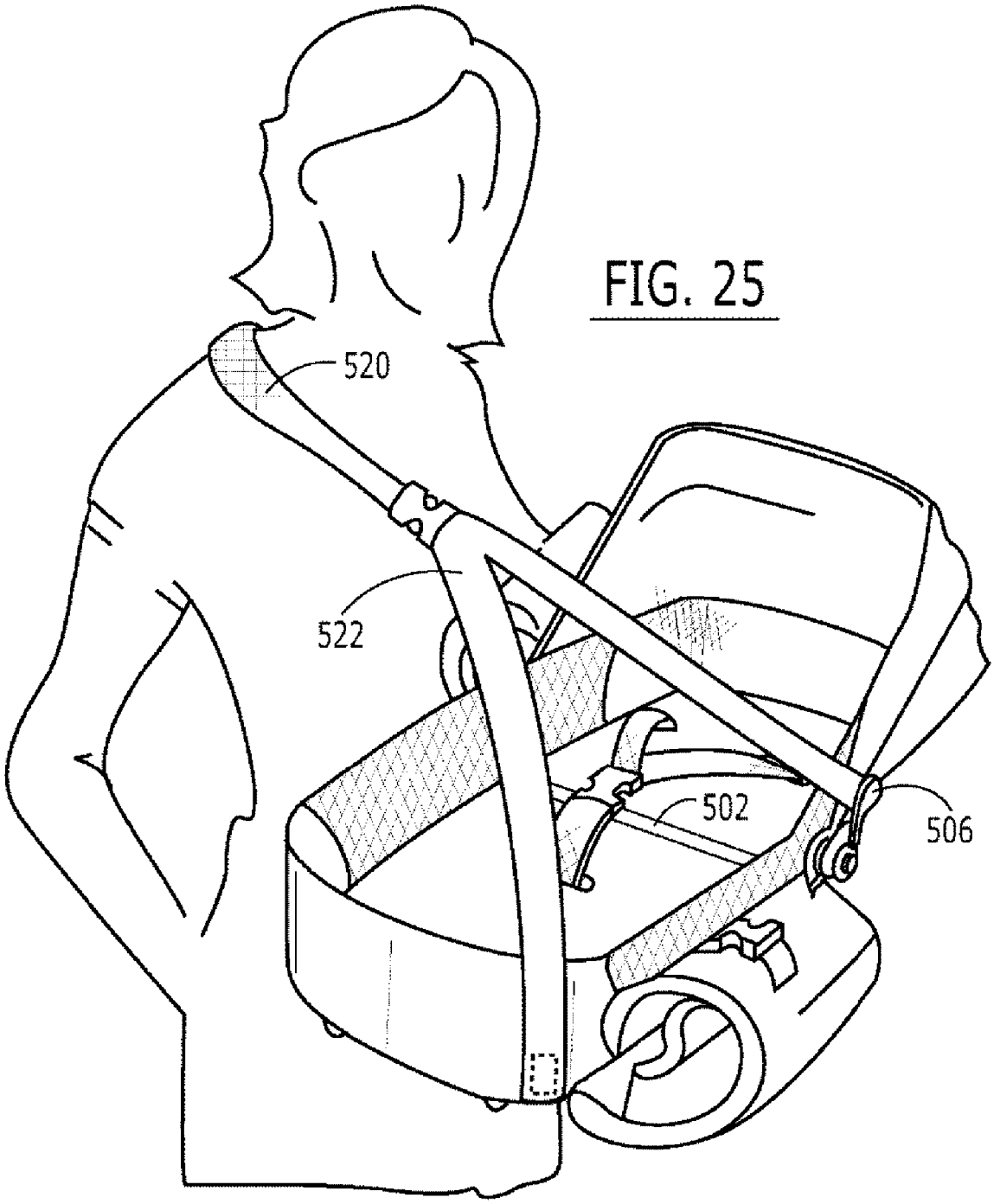
FIG. 25 is a perspective view of the baby carrier of FIG. 24 being carried by a person utilizing a shoulder strap assembly.

According to another embodiment of the invention as shown in FIGS. 21-25, a baby bag 500 (FIG. 23) is convertible to a baby carrier 500 (FIGS. 21, 24-25) that comprises a base 502 having an unfolded configuration as shown in FIGS. 21 and 24-25, and a folded configuration as shown in FIG. 22-23. The base 502 comprises a first member 502*a* for receiving the head and upper torso of a baby, and a second member 502*b* for receiving the legs of a baby. A harness 504 is attached to each of the first member and second member for securing a baby when received by the base 502 in the unfolded configuration.

A hinge-control lever 506 extends from the base 502 along the axis along which the member 502*a* and second member 502*b* are hingedly attached. When the base 502 obtains the folded configuration (FIG. 22), the first member 502*a* abuts the second member 502*b*. When the base 502 obtains the unfolded configuration (FIG. 21), the first member 502*a* and second member 502*b* are disposed in an essentially coplanar relationship. The first member 502*a* and second member 502*b* are capable of any relative disposition between the unfolded configuration (FIG. 21) and the folded configuration (FIG. 22) when the hinge-control lever 506 is unlocked. For example, in FIG. 24 the first member is slightly inclined from the completely unfolded configuration. Relative movement (hinging) between the first member and second member is arrested when the hinge-control lever is locked.

A first lateral member 508 is hingedly attached to the first member 502*a* of the base and a second lateral member 510 is hingedly attached to the second member 502*b* of the base. Each lateral member 508,510 includes a number of pockets 512 having optional closure elements such as buckles, zippers, and buttons. The pockets 512 are arranged on the faces of the lateral members that are readily accessible when either the folded configuration (FIG. 23) or the unfolded configuration (FIG. 21) of the base 502 is obtained. A pocket 509 attached to the first lateral member 508 may be specifically dimensioned to receive a mobile phone in snug fit therein. Alternatively, pocket 509 may be specifically dimensioned to receive a baby bottle in snug fit therein.

The convertible baby bag 500 is configured as a bag with a bag-carrying strap assembly 514 in FIG. 23, wherein the first lateral member abuts the first member of the base and the second lateral member 510 abuts the second member of the base. Closure elements 516 attached to the lateral members and comprising straps and quick-release buckles are useful for securing the baby bag in the bag configuration shown in FIG. 23. The closure elements 516 are further useful for securing the lateral members in rolled configurations as shown in FIG. 24.

The convertible baby bag 500 includes a collapsible canopy 518 as shown in FIGS. 21 and 24. The collapsible canopy optionally hinges about the axis along which the first member and second member of the base are hingedly attached.

The convertible baby bag 500 is configured as a baby carrier with a shoulder strap assembly in FIGS. 24 and 25. The shoulder strap assembly has a single strap portion 520 and a double strap portion 522. The double strap portion 522 is anchored to the first and second members of the base at spaced respective anchor points to assist in stabilizing the baby carrier when carried as shown in FIG. 25.

A collapsible wall 524 is attached to and extends around the perimeter of the base for encircling a baby received upon the base when the unfolded configuration (FIG. 24) is obtained. In the illustrated embodiment, the wall 524 includes sections 526 comprising mesh. The wall 524 collapses toward the base when the folded configuration is obtained (FIG. 23).

Figure 26:
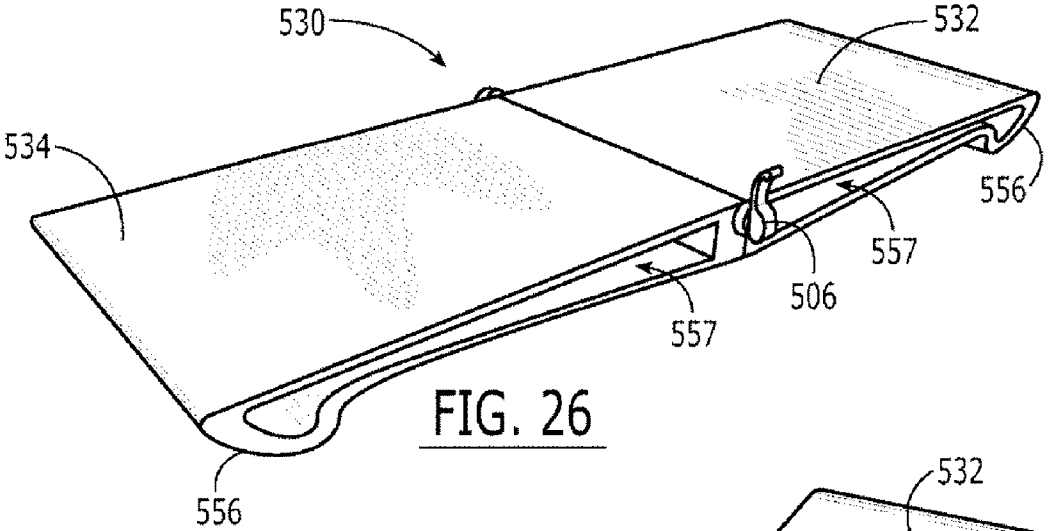
FIG. 26 is a perspective view of a hinging frame of a convertible baby bag, wherein the hinging frame is shown in an unfolded configuration.
Figure 28:
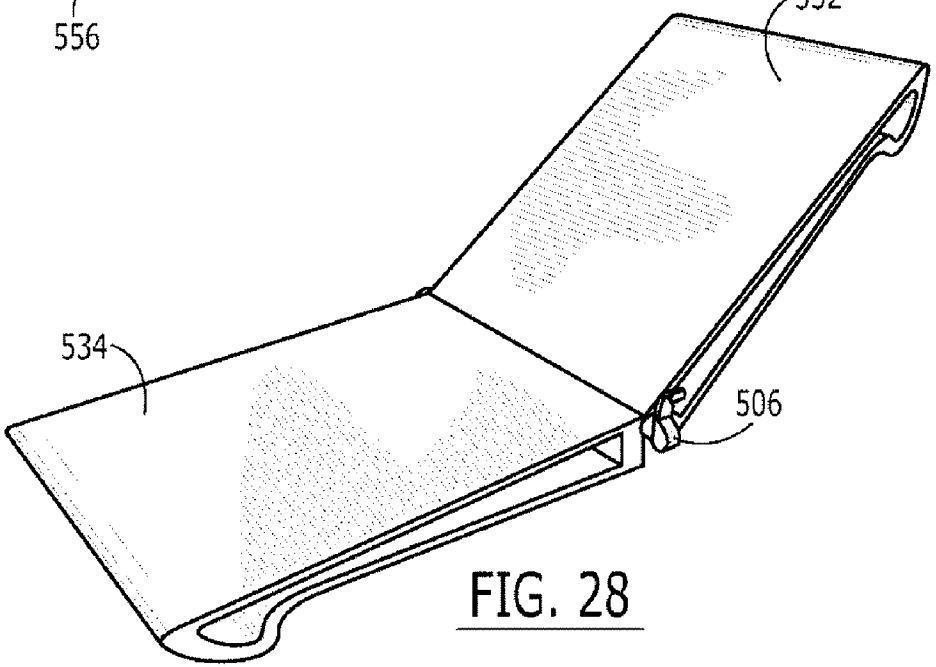
FIG. 28 is a perspective view of the hinging frame of FIG. 26, wherein the hinging frame is shown in an inclined configuration.
Figure 27:
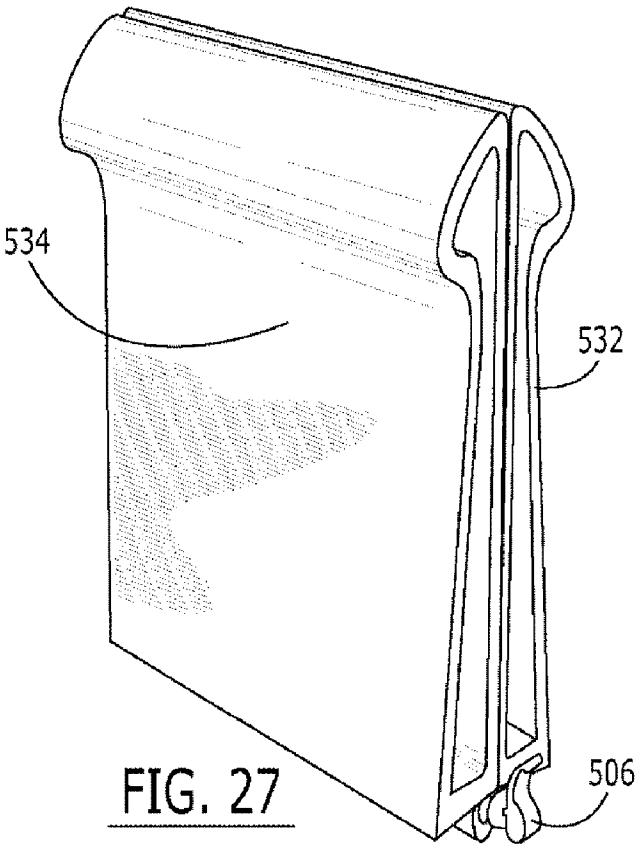
FIG. 27 is a perspective view of the hinging frame of FIG. 26, wherein the hinging frame is shown in a folded configuration.

Within the convertible baby bag 500 shown in FIGS. 21-25, a hinging frame 530 as shown in FIGS. 26-28 comprises a first frame member 532 for supporting the first member of the base, a second frame member 534 for supporting the second member of the base, and the hinge control lever 506. The hinging frame 530 obtains: the unfolded configuration shown in FIG. 26 when the base 502 (FIG. 21) obtains the unfolded configuration; the folded configuration shown in FIG. 27 when the base 502 (FIG. 22) obtains the folded configuration; and, an intermediate inclined configuration as shown in FIG. 28 when the base 502 obtains an inclined configuration. Relative movement (hinging) between the first frame member and second frame member is arrested when the hinge-control lever 506 is locked. Construction of the hinging frame 530 prevents overextension of the frame members beyond the unfolded configuration (FIG. 26).

Figure 29:
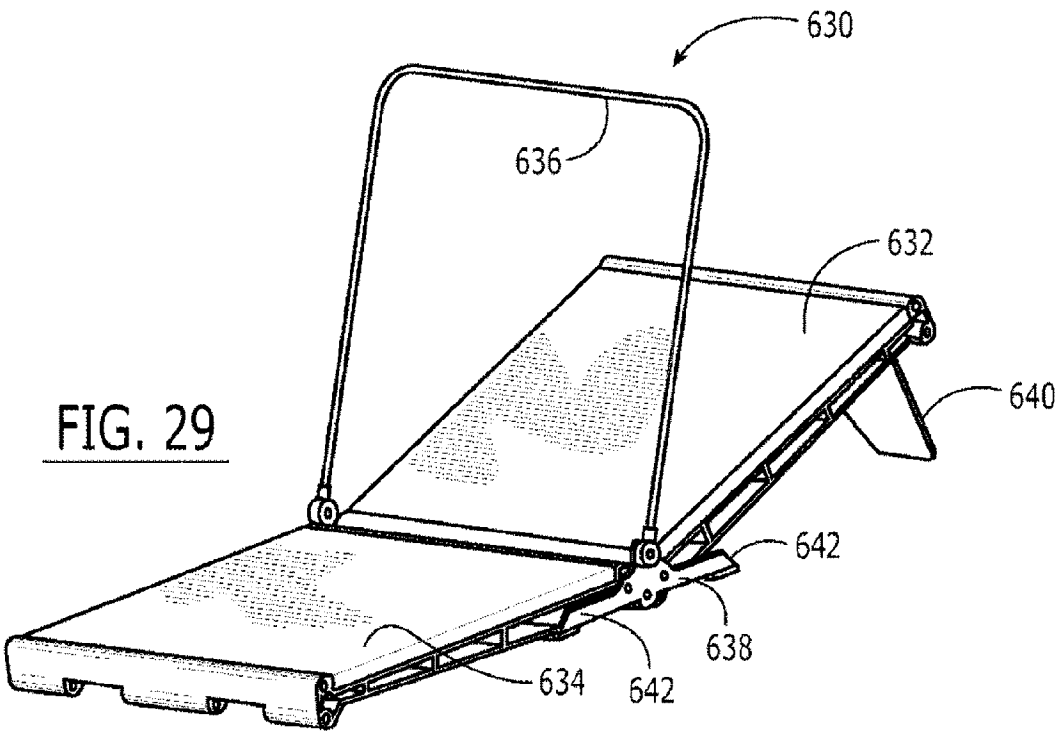
FIG. 29 is a perspective view of another embodiment of a hinging frame of a convertible baby bag, wherein the hinging frame is shown in an inclined configuration.
Figure 30:
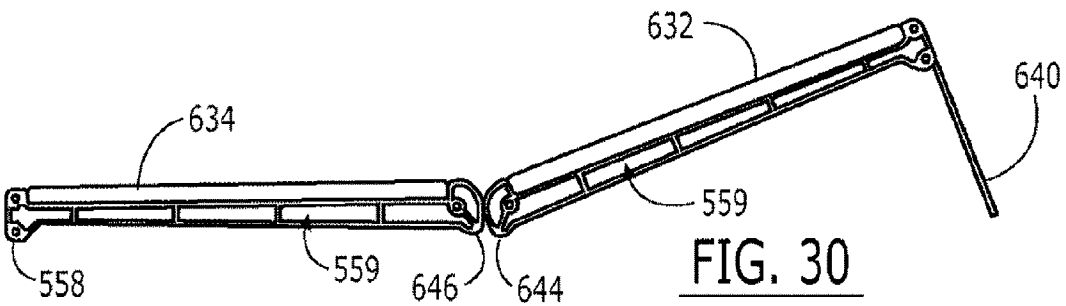
FIG. 30 is another perspective view of certain components of the hinging frame of FIG. 29.

Another embodiment of a frame for a convertible baby bag is shown in FIGS. 29-30. In FIG. 29, the hinging frame 630 includes a first frame member 632, a second frame member 634, a canopy support member 636, and a bracket 638 about which the first frame member, the second frame member and the canopy support member rotate. A leg member 640 is hingedly attached to the first frame member 632 for supporting the first frame member in an inclined configuration as shown. Horizontal support members 642 depend from the bracket providing stability to the hinging frame when placed on a horizontal surface and preventing overextension of the first frame member and second frame member beyond the horizontal. The hinging frame 630 is shown in FIG. 29 in an inclined configuration that is intermediate a folded configuration (not shown), wherein the first and second frame members are vertically disposed, and an unfolded configuration (not shown), wherein the first and second frame members are horizontally disposed.

As shown in FIG. 30, wherein the first and second frame members are maintained as in FIG. 29 but wherein the bracket 638 is not shown, overextension of the first and second frame members 632,634 beyond a horizontal configuration is further prevented by respective abutting surfaces 644,646 that abut each other when the horizontal configuration is obtained.

In addition to the foregoing detailed description, it further is noted that the embodiment of the baby carrier as shown, for example, in FIG. 21 includes feet 555 for elevation of the base of the baby carrier above a surface upon which the baby carrier may be placed. Elevation of the baby carrier is advantageous for insulating the baby carrier from heat exchange with the support surface. Feet 556 further are provided in the frame of, for example, FIG. 26 for similarly elevating a base of a baby carrier. Moreover, the frame of FIG. 26 further defines openings 557 extending therethrough containing air for further insulating the base from any support surface upon which the base may be placed. Similarly, the frame of the embodiment of, for example, FIG. 30 also includes feet 558 and openings 559 separated by support walls for elevating and insulating a base of a baby carrier.

What is claimed is:

1. A baby bag that is convertible to a baby carrier, comprising:

(a) a base that is movable between, (i) a folded configuration defining a baby bag for storage and transport thereof, and (ii) an unfolded configuration defining a baby carrier for receiving a baby thereon; and (b) a harness connected to said base for restraining a baby received upon said base when said base is in said unfolded configuration, said harness configured to restrain a baby such that a back of the baby is maintained in close proximity to said base;

(c) wherein said base includes first and second rigid planar members coupled together and movable, (i) from a first position, corresponding to said base being in the unfolded configuration, (A) wherein said first and second rigid members are disposed in coplanar relation to one another, with proximal ends thereof spaced apart from one another, and (B) wherein said first and second rigid members are configured to support a baby received upon said base, (ii) to a second position, corresponding to said base being in the folded configuration, (A) wherein said first and second rigid members are disposed in spaced parallel relation to one another, and (B) wherein said first and second rigid members define therebetween an interior space;

(d) wherein said base comprises a third member that is rigid and planar and that extends between and connects said first rigid member and said second rigid member; and (e) wherein overextension of said base is prevented by abutment of an overlapping portion of said first rigid member with said third rigid member, and abutment of an overlapping portion of said second rigid member with said third rigid member.

2. The baby bag of claim 1, wherein the moving of said base from the folded configuration to the unfolded configuration includes rotating said first rigid member relative to said third member, and rotating said second rigid member relative to said third member.

3. The baby bag of claim 1, wherein said first and second rigid members are parallel to, but not coplanar with, said third rigid member when said first and second rigid members are in their said respective abutment with said third rigid member for preventing overextension of said base.

4. The baby bag of claim 1, further comprising a shoulder strap removably attached to said base proximate said third member.

5. The baby bag of claim 1, wherein said base is cushioned for receiving a baby in comfort.

6. The baby bag of claim 1, wherein said baby bag includes a plurality of pockets, and wherein at least one said pocket is disposed on a member that is connected to said base for hinging movement relative thereto.

7. The baby bag of claim 1, wherein said baby bag includes a plurality of pockets, and wherein at least one said pocket is dimensioned to receive a mobile phone.

8. The baby bag of claim 1, wherein said baby bag includes a plurality of pockets, and wherein at least one said pocket is dimensioned to receive a baby bottle, said pocket being disposed on the outside of said baby bag when said base is in said folded configuration.

9. The baby bag of claim 1, wherein said baby bag includes a plurality of pockets, and wherein at least one said pocket is dimensioned to receive an umbrella when said base is in said unfolded configuration for shading of a baby received upon said base.

10. The baby bag of claim 1, wherein said baby bag further comprises a canopy for covering of a baby when received on said base.

11. The baby bag of claim 1, further comprising an anchor strap connected to said base proximate said third member for receipt there through of a belt.

12. A method of using the convertible baby bag of claim 1 for carrying a baby, comprising the steps of, (a) converting the baby bag to the baby carrier by moving the base into the unfolded configuration;

(b) placing a baby upon the base in the unfolded configuration;

(c) restraining the baby to the base using the harness such that a back of the baby is maintained adjacent the base; and (d) carrying the base with the baby restrained to the base.

13. The baby bag of claim 1, wherein said baby bag further comprises a collapsible wall attached to and extending around a perimeter of said base for encircling a baby received upon said base when said base is in said unfolded configuration, said wall collapsing toward said base when said base is moved into said folded configuration.

14. The baby bag of claim 13, wherein said collapsible wall includes sections comprising mesh.

15. The baby bag of claim 1, wherein said baby bag further comprises a cushion for partially surrounding a baby's head when received upon said base.

16. The baby bag of claim 15, wherein said cushion is removably attached to said base via hook-and-loop fasteners.

17. The baby bag of claim 1, wherein said baby bag further comprises a blanket for covering of a baby received upon said base.

18. The baby bag of claim 17, wherein said blanket is removably attached to said base via hook-and-loop fasteners.

19. A baby bag that is convertible to a baby carrier, comprising:

(a) a base that is movable between (i) a folded configuration for storage and transport of the baby bag, and (ii) an unfolded configuration for receiving a baby; and (b) a shoulder strap attached to said base when said base is in said unfolded configuration for suspension of said base, whereby a baby received upon said base may be carried by a person utilizing said shoulder strap;

(c) wherein said base includes first and second rigid planar members coupled together and movable, (i) from a first position, corresponding to said base being in the unfolded configuration, (A) wherein said first and second rigid members are disposed in coplanar relation to one another, with proximal ends thereof spaced apart from one another, and (B) wherein said first and second rigid members are configured to support a baby received upon said base, (ii) to a second position, corresponding to said base being in the folded configuration, (A) wherein said first and second rigid members are disposed in spaced parallel relation to one another, and (B) wherein said first and second rigid members define therebetween an interior space;

(d) wherein said base comprises a third member that is rigid and planar and that extends between and connects said first rigid member and said second rigid member; and (e) wherein overextension of said base is prevented by abutment of an overlapping portion of said first rigid member with said third rigid member, and abutment of an overlapping portion of said second rigid member with said third rigid member.

20. A method of using the convertible baby bag of claim 19 for carrying a baby, comprising the steps of, (a) converting the baby bag to the baby carrier by moving the base into the unfolded configuration;

(b) placing a baby upon the base in the unfolded configuration; and (c) suspending the base and the baby placed thereon by the shoulder strap.

* * * * *